US006997451B2

(12) United States Patent
Yoshimura et al.

(10) Patent No.: US 6,997,451 B2
(45) Date of Patent: Feb. 14, 2006

(54) SHEET POST-PROCESSING DEVICE AND IMAGE FORMING APPARATUS

(75) Inventors: Kenichi Yoshimura, Kofu (JP); Satoshi Iwama, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 53 days.

(21) Appl. No.: 10/440,172

(22) Filed: May 19, 2003

(65) Prior Publication Data

US 2003/0219294 A1 Nov. 27, 2003

(30) Foreign Application Priority Data

May 20, 2002 (JP) ..... 2002-144190

(51) Int. Cl.
*B65H 37/04* (2006.01)

(52) U.S. Cl. ..... 270/58.12; 270/58.08; 399/410

(58) Field of Classification Search ..... 270/58.08, 270/58.09, 58.11, 58.12; 399/410
See application file for complete search history.

(56) References Cited

U.S. PATENT DOCUMENTS

| | | | | |
|---|---|---|---|---|
| 5,114,130 | A * | 5/1992 | Hamanaka et al. | 270/58.11 |
| 5,639,080 | A * | 6/1997 | Evans | 270/58.28 |
| 5,839,048 | A * | 11/1998 | Kato | 399/407 |
| 6,241,234 | B1 * | 6/2001 | Saitoh et al. | 270/58.12 |
| 6,382,614 | B1 * | 5/2002 | Fukatsu et al. | 270/58.11 |
| 6,457,705 | B2 * | 10/2002 | Nanba et al. | 270/58.12 |

FOREIGN PATENT DOCUMENTS

JP 10-218451 8/1998

* cited by examiner

*Primary Examiner*—Patrick Mackey
(74) *Attorney, Agent, or Firm*—Manabu Kanesaka

(57) ABSTRACT

A sheet post-processing device includes a placement unit for placing a sheet discharged from an image forming apparatus; a discharging unit for successively discharging the sheet on the placement unit; and an offset unit for shifting an edge of a stitching sheet from an edge of a non-stitching sheet on the placement unit by a predetermined distance depending on whether the sheet discharged on the placement unit is subjected to a stitching process. A stitching unit stitches only the edge portions of the stitching sheets in a stack in a state that the edges of the stitching sheets are shifted from the edge of the non-stitching sheet by the offset unit.

18 Claims, 24 Drawing Sheets

SHEET POST-PROCESSING DEVICE AND IMAGE FORMING APPARATUS

BACKGROUND OF THE INVENTION AND RELATED ART STATEMENT

The present invention relates to a sheet post-processing device and an image processing apparatus, and more particularly, to a sheet post-processing device for performing a stitching operation on a sheet discharged from an image forming apparatus and an image forming apparatus equipped with the sheet post-processing device.

A conventional sheet post-processing device (finishers) performs a stitching operation on a plurality of sheets having an image recorded thereon and discharged from an image forming apparatus, and binds the sheets into a booklet. The finished booklet is neat with edges of the sheets well aligned.

A booklet produced by the conventional sheet post-processing device is occasionally attached with a reference such as a statistical graph and a description thereof. In such a booklet, the graphic reference and the description thereof are typically bound at different locations. Accordingly, to correlate the content of the graphic reference page with the description, the reader must turn the reference page and the description page frequently. It takes time and effort to turn the pages to understand the content of the whole booklet.

It is an object of the present invention to provide a sheet post-processing device for allowing a reader to quickly comprehend a relationship of contents of a booklet, and an image forming apparatus equipped with such a sheet post-processing device.

Further objects and advantages of the invention will be apparent from the following description of the invention.

SUMMARY OF THE INVENTION

According to the first aspect of the present invention, a sheet post-processing device includes a placement unit for placing a sheet discharged from an image forming apparatus; a discharging unit for successively discharging the sheet on the placement unit; an offset unit for successively shifting an edge of the sheet to be stitched from an edge of the sheet not to be stitched on the placement unit by a predetermined distance depending on whether the sheet discharged on the placement unit is subjected to a stitching process; and a stitching unit for stitching only the edge of the sheet to be stitched in a stack in a state that the edge of the sheet to be stitched is shifted from the edge of the sheet not to be stitched by the offset unit.

In the first aspect of the present invention, the offset unit successively shifts the edge of the sheets to be stitched from the edge of the sheets not to be stitched on the placement unit by the predetermined distance depending on whether the sheets discharged on the placement unit are subjected to the stitching process. The stitching unit stitches only the edges of the sheets to be stitched in the stack in the state that the edges of the sheets to be stitched are shifted from the edge of the sheets not to be stitched by the offset unit. The offset unit shifts the sheets to be stitched from the sheets not to be stitched, and the stitching unit stitches only the edges of the sheets to be stitched. Accordingly, the unstitched sheets are shifted from a stack of the stitched sheets and easy to be pulled out. It is easy to view the pulled sheets in comparison with the stack of the stitched sheets. The user thus easily learns a relationship of contents in a booklet bound by the sheet post-processing device.

According to the second aspect of the present invention, a sheet post-processing device includes a placement unit for placing sheets discharged from an image forming apparatus; a discharging unit for successively discharging the sheets on the placement unit; an offset unit for successively shifting edges of the sheets to be stitched from edges of the sheets not to be stitched on the placement unit by a predetermined distance depending on whether the sheets discharged on the placement unit are subjected to a stitching process; a stitching unit for stitching only the edges of the sheets to be stitched in a stack in a state that the edges of the sheets to be stitched are shifted from the edges of the sheets not to be stitched by the offset unit; a conveyance unit for conveying the stack of the sheets stitched by the stitching unit; and a storage unit for storing the stack of the sheets conveyed by the conveyance unit.

In the second aspect of the present invention, the conveyance unit and the storage unit are included in addition to the construction of the first aspect of the present invention. Therefore, in addition to the advantages provided by the first aspect, the second aspect allows the stitched stack of the sheets to be conveyed to the storage unit. The storage unit may be arranged at upstream or downstream of the placement unit.

In the second aspect of the present invention, the conveyance unit conveys the stack of the sheets to the storage unit in a state that the edges of the sheets stitched by the stitching unit are positioned at downstream. When the unstitched sheets contact the conveyance unit like a conveyance roller during conveyance, the unstitched sheet is pushed toward the stack of the sheets, thereby preventing the unstitched sheets from coming off the stack of the sheets.

Further, the conveyance unit contact the edges of the sheets stitched by the stitching unit to convey the stack of the sheets to the storage unit. Accordingly, the conveyance unit does not contact the unstitched sheets, and the unstitched sheets do not come off the stack of the sheets during conveyance.

The conveyance unit may contact only the sheets stitched by the stitching unit. In this arrangement, the conveyance unit does not contact the unstitched sheets. The unstitched sheets do not come off the stack of the sheets during conveyance when the edges of the sheets are positioned at downstream.

In the first and second aspects of the present invention, the stitching unit stitches the sheets at a position within a predetermined distance from the edges of the sheets to be stitched. The sheets to be stitched are shifted from the sheets not to be stitched, and the sheets to be stitched are stitched at the position within the predetermined distance from the edge thereof. Thus, the sheets not to be stitched are not accidentally stitched together with the sheets to be stitched.

Further, it may be arranged that, among the sheets forming the stack discharged into the placement unit, at least the first sheet and the last sheet are stitched. With this arrangement, the stack of the sheets is formed with the unstitched sheets interposed between the stitched sheets. The stitched sheets and unstitched sheets are thus handled as a single stack of the sheets.

Further, the offset unit shifts the edges of the sheets not to be stitched with each other on the placement unit. With this arrangement, when a plurality of sheets is not to be stitched, the unstitched sheets are interposed in the stack of the sheets, thereby making it easy to pull out any particular unstitched sheet.

In the first and second aspects of the present invention, the offset unit may include a restraining member being movable between a restraining position at which the restraining member restrains and aligns the edges of the sheets discharged into the placement unit and a retraction position to which the restraining member is retracted from the restraining position thereof; an urging member for urging the sheets discharged on the placement unit by the discharging unit toward the restraining member; and a sheet moving member being movable between a first position at which the sheet moving member moves all the sheets nipped on the placement unit and a second position at which the sheet moving member is spaced from the sheets on the placement unit and allows the urging member to urge the sheets.

In this configuration, the urging member urges the discharged sheets toward the restraining unit so that the sheets to be stitched are placed on the placement unit at a position different from that of the sheets not to be stitched, in a state that the restraining member and the sheet moving member stay at the restraining position and at the second position, respectively. In this case, it is possible to shift the forward edges of the sheets to be stitched urged by the urging member from the forward edge of the sheet not to be stitched by a predetermined distance. The forward edges of the sheets not to be stitched may be successively shifted with each other when there is a plurality of the sheets not to be stitched.

Further, the sheet moving member may nip and move all the sheets on the placement unit at the first position while the sheets to be stitched and the sheets not to be stitched maintained at the different placement positions in a state that the restraining member is at the retraction position thereof. The sheet moving member may move all the sheets placed on the placement unit to different placement positions for each sheet not to be stitched when there is a plurality of sheets not to be stitched. In this arrangement, a shift is created between each of the unstitched sheets. The unstitched sheets in the shifted state thereof are thus interposed in the stack of sheets, and any particular unstitched sheet is easily pulled out.

The sheet post-processing device may further include a pressing member for pressing all the sheets placed on the placement unit when a new sheet to be stitched is urged by the urging member with the restraining member and the sheet moving member respectively staying at the restraining position and the second position after the sheet not to be stitched is stacked on the sheet to be stitched. The pressing member presses all the sheets on the placement unit. Therefore, it is possible to maintain a posture of the sheets to be stitched and the sheets not to be stitched on the placement unit even when a new sheet to be stitched is urged by the urging member.

According to the third aspect of the present invention, an image forming apparatus includes a sheet post-processing device. The sheet post-processing device includes an offset unit for successively shifting edges of sheets to be stitched from edges of sheets not to be stitched on a placement unit by a predetermined distance depending on whether the sheets discharged on the placement unit are subjected to a stitching process; and a stitching unit for stitching only the edges of the sheets to be stitched in a stack in a state that the edges of the sheets to be stitched are shifted from the edges of the sheets not to be stitched by the offset unit.

The sheet post-processing device further includes a designating unit for designating the sheets as to whether the sheets are to be stitched or not to be stitched, and a notifying unit of notifying the sheet post processing device of the information of the sheets designated by the designating unit as to whether the sheets are to be stitched or not to be stitched.

In the third aspect of the present invention, the designating unit designates the sheets as to whether the sheets are to be stitched or not to be stitched, and the notifying unit notifies the sheet post processing device of the information of the sheets designated by the designating unit as to whether the sheets are to be stitched or not to be stitched. Therefore, in the sheet post-processing device, the offset unit successively shifts the edges of the sheets to be stitched from the edges of the sheets not to be stitched on the placement unit by the predetermined distance depending on whether the sheets discharged on the placement unit are subjected to the stitching process. The stitching unit stitches only the edges of the sheets to be stitched in the stack of the sheets in the state that the edges of the sheets to be stitched are shifted from the edges of the sheets not to be stitched by the offset unit.

With this arrangement, the offset unit shifts the sheets to be stitched from the sheets not to be stitched, and the stitching unit stitches only the edges of the sheets to be stitched. As a result, the unstitched sheets are shifted from the stack of the stitched sheets, and it is easy to pull out the unstitched sheets. It is possible to view the pulled sheets in comparison with the stack of the stitched sheets. Therefore, it is easy to understand a relationship in the contents of the booklet bound by the image forming apparatus.

BRIEF DESCRIPTION OF THE DRAWINGS

FIGS. 14(A)–14(C) are views showing a detail of a side staple mode, wherein FIG. 14(A) is a side view of a sheet stack in a standard mode, FIG. 14(B) is a side view of a sheet stack in an insert mode, and FIG. 14(C) is a side view of a sheet stack in an offset insert mode;

FIGS. 15(A)–15(C) are views showing operations of an offset unit in the insert mode, wherein FIG. 15(A) is a view showing an operation No. 1, FIG. 15(B) is a view showing an operation No. 2, and FIG. 15(C) is a view showing an operation No. 3;

FIGS. 16(A)–16(C) are views showing operations of the offset unit in the insert mode, wherein FIG. 16(A) is a view showing an operation No. 4, FIG. 16(B) is a view showing an operation No. 5, and FIG. 16(C) is a view showing an operation No. 6;

FIGS. 17(A)–17(C) are views showing operations of the offset unit in the insert mode, wherein FIG. 17(A) is a view showing an operation No. 7, FIG. 17(B) is a view showing an operation No. 8, and FIG. 17(C) is a view showing an operation No. 9;

FIGS. 18(A)–18(C) are views showing operations of the offset unit in the offset insert mode different from those in the offset mode, wherein FIG. 18(A) is a view showing an operation No. 1, FIG. 18(B) is a view showing an operation No. 2, and FIG. 18(C) is a view showing an operation No. 3;

FIGS. 19(A)–19(C) are views showing operations of the offset unit in the offset insert mode different from those in the offset mode, wherein FIG. 19(A) is a view showing an operation No. 4, FIG. 19(B) is a view showing an operation No. 5, and FIG. 19(C) is a view showing an operation No. 6;

FIGS. 24(A) and 24(B) are views showing states of the folding unit in the side staple mode, wherein FIG. 24(A) is a side view showing a state of the folding unit prior to a sheet folding operation, and FIG. 24(B) is a side view showing a state of the folding unit in the folding operation.

DETAILED DESCRIPTION OF PREFERRED EMBODIMENTS

Hereunder, embodiments of the present invention will be explained with reference to the accompanying drawings.

Figure 1:
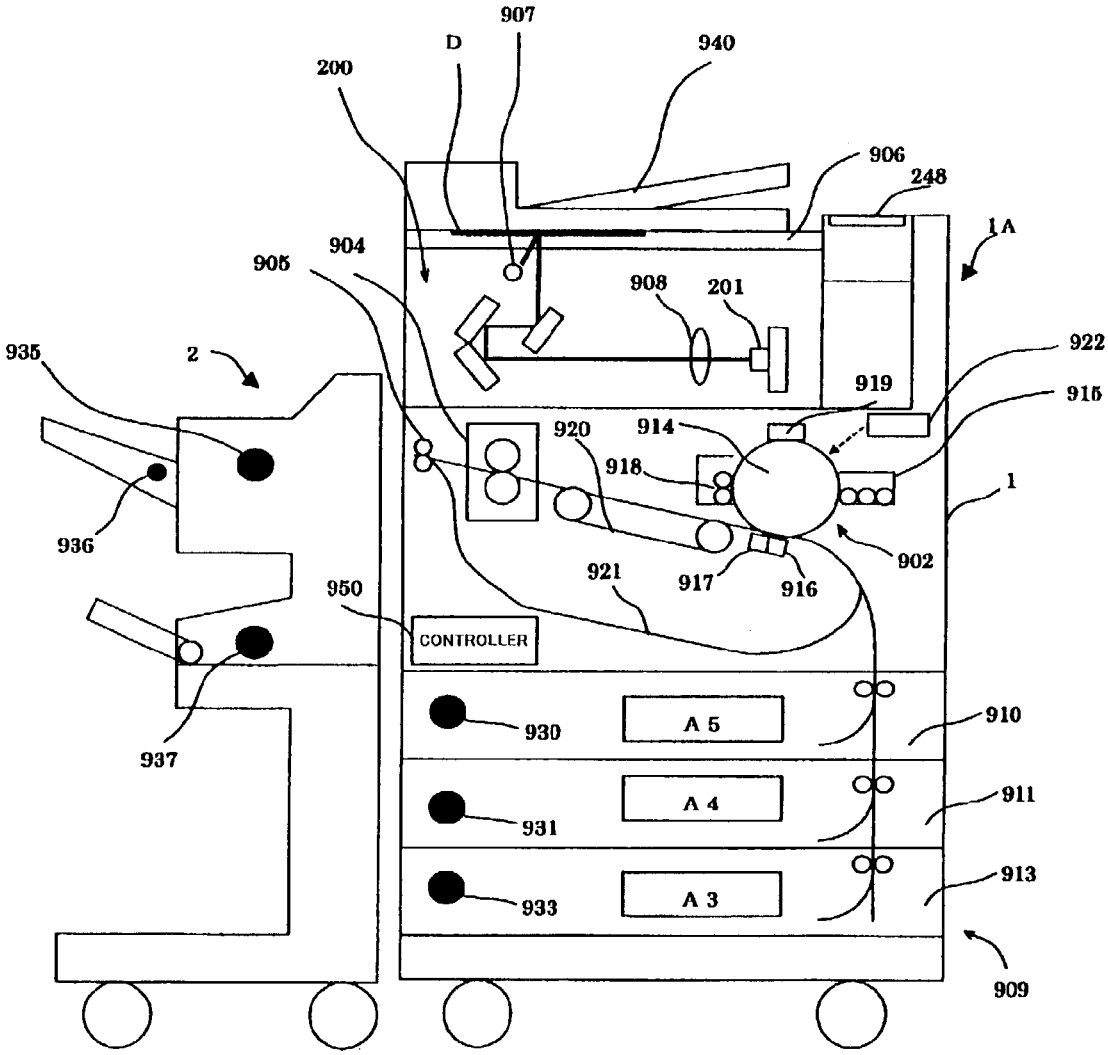
FIG. 1 is a side view of a digital copying apparatus according to the present invention.

As shown in FIG. 1, according to an embodiment of the present invention, a digital copying apparatus 1A includes a digital copying apparatus main unit 1 for forming an image on a sheet, and a sheet post-processing device 2 detachably mounted on the digital copying apparatus main unit 1 for performing a stitching operation and a folding operation on sheets discharged from the digital copying apparatus main unit 1.

The digital copying apparatus main unit 1 includes an image forming assembly 902 for recording an image of an original document D on the sheet; an image input unit 200 provided as a so-called scanner for focusing light reflected from the original document D on a CCD 201 through an optical system 908 and having a light source 907 disposed above the image forming assembly 902 for emitting light toward the original document D; a sheet feeder 909 arranged below the image forming assembly 902 for feeding the sheets to the image forming assembly 902 one by one; and a controller 950 for controlling these components.

The sheet feeder 909 is detachably mounted on the digital copying apparatus main unit 1, and includes a cassette 910 for holding A5 size sheets, cassette 911 for holding A4 size sheets, and cassette 913 for holding A3 size sheets. The cassettes 910, 911 and 913 are respectively provided with an A5 size sheet cassette selection switch 930 for manually selecting the A5 size sheets, an A4 size sheet cassette selection switch 931 for manually selecting the A4 size sheets, and an A3 size sheet cassette selection switch 933 for manually selecting the A3 size sheets. It is possible to manually select a sheet size by pressing one of the switches arranged on the respective cassettes while visually checking the sheet size. It is also possible to select a sheet size through a touch panel 248 as described later.

The image forming assembly 902 includes a cylindrical photoconductive drum 914 for forming an electrostatic latent image on a circumference thereof. Arranged around the photoconductive drum 914 are a primary charging unit 919 for charging the photoconductive drum 914 for latent image formation; laser unit 922 for outputting a laser beam modulated in accordance with image data stored in a hard disk 961 (described later) to the photoconductive drum 914; a development unit 915 for developing the electrostatic latent image formed on the photoconductive drum 914 into a toner image; a transfer unit 916 for transferring the toner image onto the sheet; a separating charging unit 917 for charging the sheet in a polarity opposite to the transfer unit 916 to separate the sheet from the photoconductive drum 914; and a cleaner 918 for cleaning the photoconductive drum 914.

The laser unit 922 includes a semiconductor laser for generating a laser beam; a polygon mirror for converting the laser beam emitted from the semiconductor laser into a beam for a single scan line through a collimator lens; an fθ lens for collimating the laser beam for a scanning line from the polygon mirror; a mirror for guiding the collimated laser beam from the fθ lens to the photoconductive drum 914; and a motor for rotating the polygon mirror.

An endless conveyance belt 920 is wrapped and extended between rollers. One of the rollers is disposed at downstream of the photoconductive drum 914 and in the vicinity of the separating charging unit 917. The other of the rollers is disposed in the vicinity of a fixing unit 904 having a heater roller to heat and fix the toner image onto the sheet. A pair of discharge rollers 905 is arranged at downstream of the fixing unit 904 for discharging the sheet bearing an image thereon from the digital copying apparatus main unit 1. A duplexer 921 is arranged below the endless conveyance belt 920 between the discharge roller pair 905 and an upstream side of the photoconductive drum 914 for forming an image on the backside of the sheet with the image on the front side thereof for performing a both-side printing operation.

The digital copying apparatus main unit 1 also includes a platen glass 906 for receiving a document D thereon at an upper portion of the main unit, and a touch panel 248 for displaying a status of the digital copying apparatus 1A in accordance with information from a controller 950 and for receiving a command to the controller 950 from an operator. An automatic document feeder (ADF) 940 is arranged above the platen glass 906 for automatically feeding the document D to the platen glass 906. One side of the ADF 940 is fixed to an upper portion of the digital copying apparatus main unit 1, and the other side of the ADF 940 rotatably covers the platen glass 906.

Figure 2:
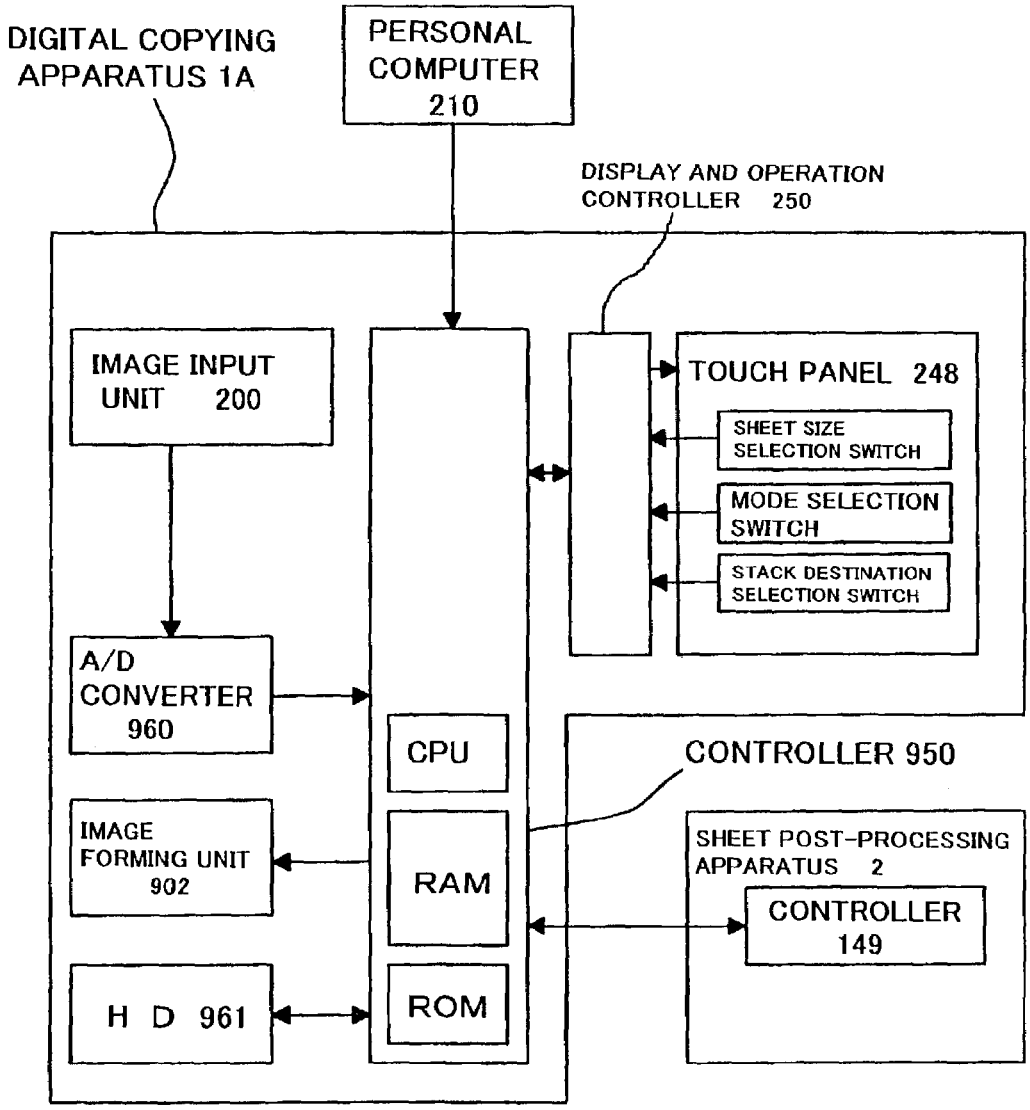
FIG. 2 is a block diagram illustrating a controller of a main unit of the digital copying apparatus.

As shown in FIG. 2, the controller 950 includes a central processing unit (CPU); a ROM storing a basic control program of the digital copying apparatus 1A; a RAM serving as a work area of the CPU; and an internal bus for connecting these components. An external bus is connected to the controller 950. The external bus through an interface (not shown) is connected to a personal computer 210; an A/D converter 960 for converting analog image data input through the image input unit 200 into digital data; a hard disk 961 for storing image data output from one of the image forming assembly 902, an image input unit 200, and the personal computer 210; a touch panel display operation controller 250 for controlling a display on the touch panel 248 and an operation command; and a controller 149 in the sheet post-processing device 2. The image input unit 200 is connected to the A/D converter 960, and the touch panel display operation controller 250 is connected to the touch panel 248.

The touch panel 248 functions as a sheet size selection switch for selecting a sheet size, a mode selection switch for selecting one of a non-stapling mode, side stapling mode, saddle stitching mode, etc. (described later), and a stack destination selection switch for selecting a destination of a booklet processed through the selected mode.

Figure 3:
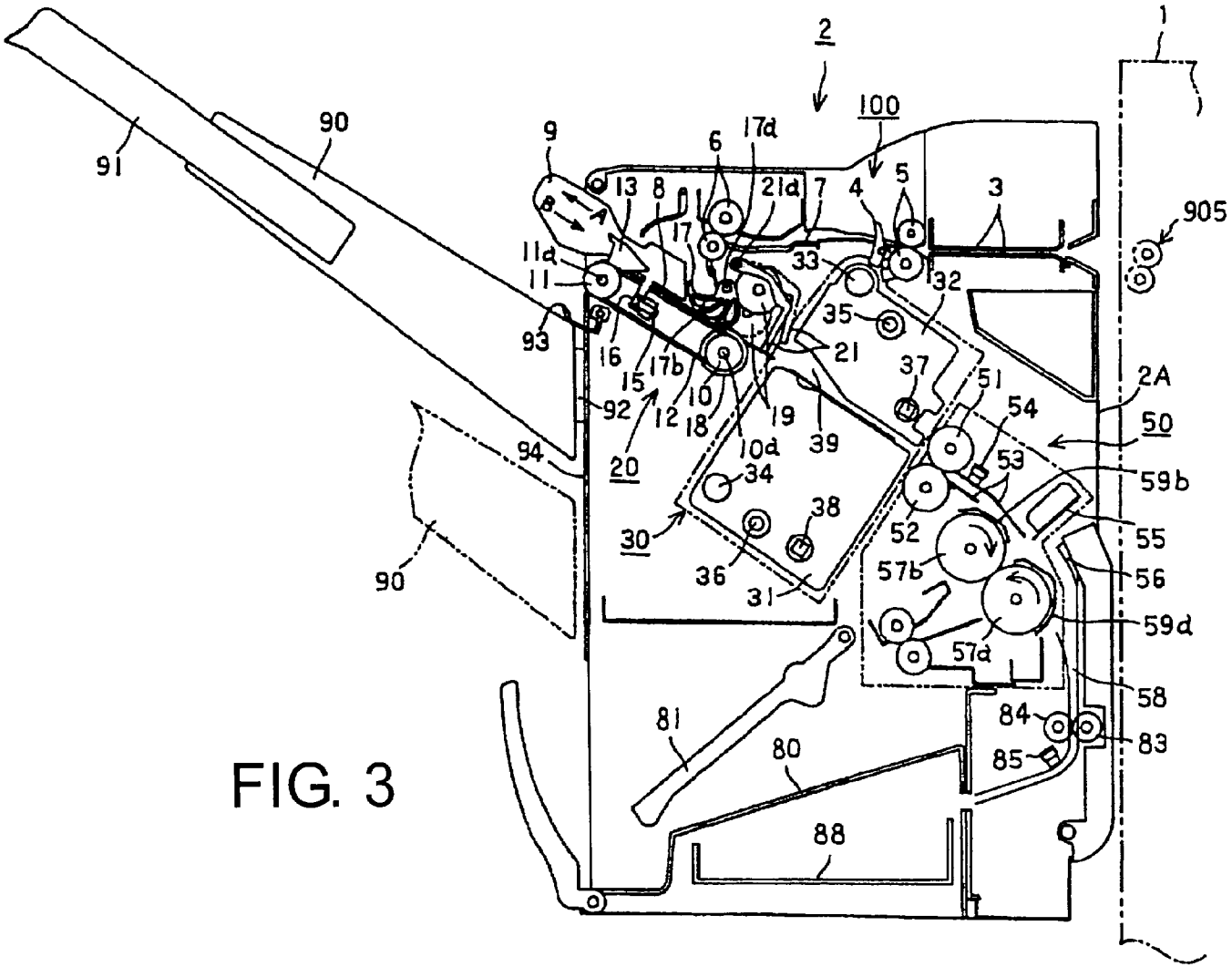
FIG. 3 is a side view of a sheet post-processing device.

As shown in FIG. 3, the sheet post-processing device 2 includes, in a device frame 2A as a casing of the sheet post-processing device 2, a conveyance unit 100 for conveying the sheet discharged from the digital copying apparatus main unit 1 in a substantially horizontal direction opposite to the discharge roller pair 905; an offset unit 20 arranged obliquely below the conveyance unit 100 for shifting an edge of the sheet; a stapler unit 30 arranged obliquely at downstream of the offset unit 20 for performing a stitching process on a sheet stack formed of a plurality of the sheets; a folding unit 50 arranged obliquely at downstream of the stapler unit 30 for performing a folding process on a folding position of the sheet stack as a predetermined position; a stack unit for collecting the sheets or booklet; and a controller for controlling these units in the sheet post-processing device 2.

The conveyance unit 100 includes a conveyance guide 3 for receiving the sheets successively discharged from the digital copying apparatus main unit 1 and guiding the sheets into the sheet post-processing device 2; a conveyance path guide 7 arranged at downstream of the conveyance guide 3 for guiding the sheets toward further downstream; a pair of conveyance rollers 5 arranged between the conveyance guide 3 and conveyance path guide 7 for nipping and conveying the sheets; a sheet detector sensor 4 arranged in the vicinity of a downstream position of the conveyance roller pair 5 for detecting the sheets brought into the conveyance path guide 7 and a jam of the sheets in the conveyance unit 100; and a pair of discharge rollers 6 arranged at the most downstream position in the conveyance path guide 7 for nipping and discharging the sheets.

As shown in FIG. 3, the offset unit 20 includes a process tray 8 for collecting the sheets discharged through the discharge roller pair 6. The process tray 8 is arranged obliquely with an angle of about 30 degrees relative to a placement surface of the digital copying apparatus main unit 1 downwardly in the sheet conveyance direction to assist the offset unit 20 to convey the sheet. Alignment plates 9 are disposed on the process tray 8 for guiding both sides of the sheets for alignment in a width direction.

Figure 4:
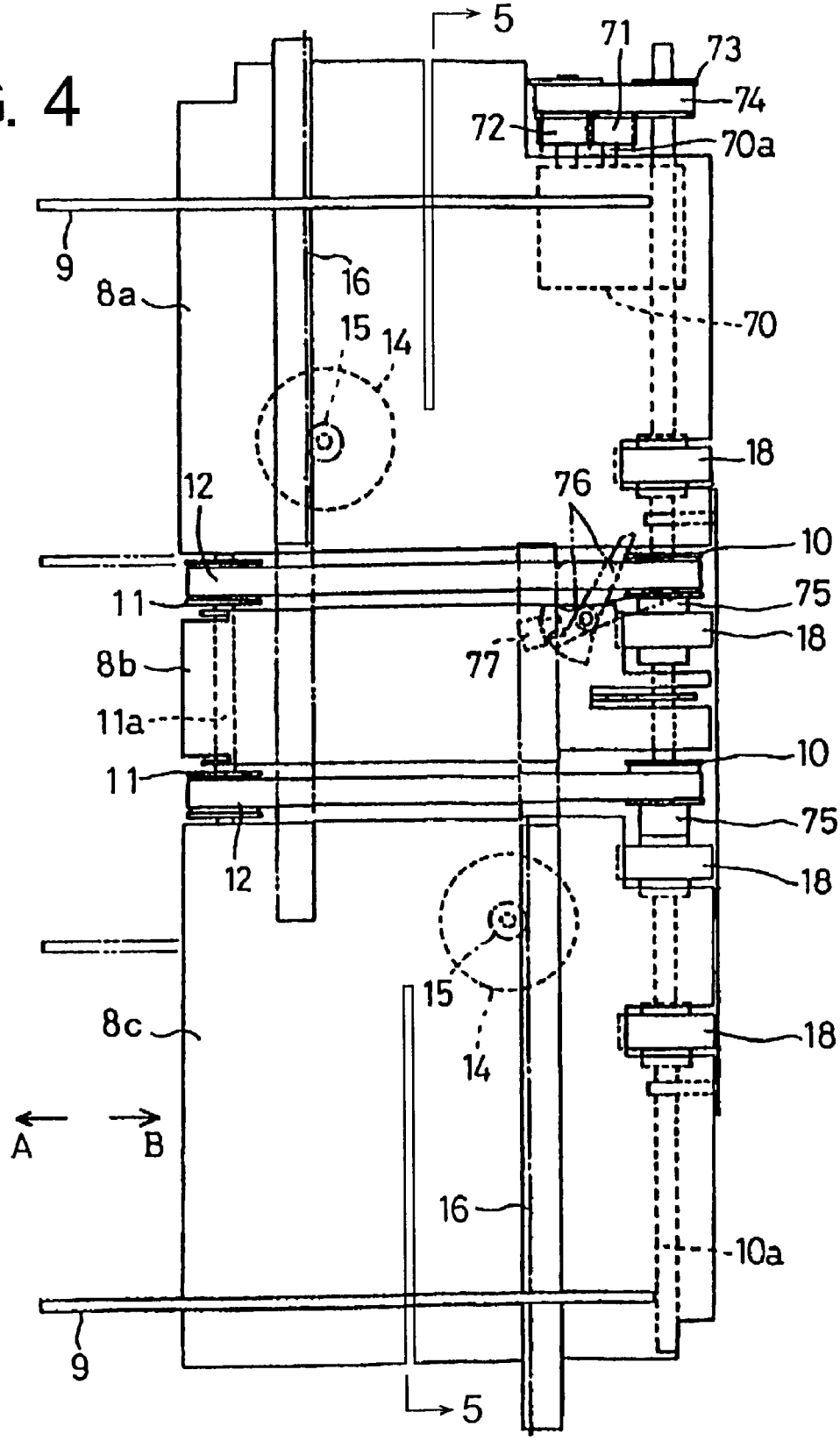
FIG. 4 is a plan view of a process tray of the sheet post-processing device.

As shown in FIG. 4, the process tray 8 has a rectangular shape elongated in a width direction substantially perpendicular to the sheet conveyance direction (i.e., a direction represented by an arrow B). The process tray 8 is divided into three portions, namely, a left tray 8*c* supporting a left portion (top portion in FIG. 4) of the sheet advancing in the sheet conveyance direction, a center tray 8*b* supporting a center portion of the sheet, and a right tray 8*a* supporting a right portion (bottom portion in FIG. 4).

Alignment motors 14 rotatable in forward and reverse directions are arranged on the left tray 8*c* and right tray 8*a* at lower portions thereof near the center tray 8*b*, respectively. Each of the alignment motors 14 has a pinion 15 fixed to a motor shaft thereof. The pinion 15 engages a rack 16 having a length substantially the same as that of the left tray 8*c* and right tray 8*a* in the width direction.

A fixing member having an elongated rectangular shape extends from a lower portion of each of the alignment plates 9. An end of the fixing member is fixed to the rack 16 through a slit extending in the width direction of the left tray 8*c* and right tray 8*a* (see also FIG. 3). The alignment plates 9 are thus movable in the width direction of the right tray 8*a* and left tray 8*c* as the alignment motors 14 rotate.

A stepping motor 70 rotatable in forward and reverse directions is arranged below the right tray 8*a* at one side thereof (a side of the stapler unit 30). The stepping motor 70 has a gear 71 fixed to a motor shaft 70*a* thereof. The gear 71 engages a gear portion of a gear pulley 72 pivotally supported on a fixed arm extending from the stepping motor 70. A timing belt 74 is placed between a pulley portion of the gear pulley 72 and a pulley 73. The pulley 73 is fixed to a first pulley shaft 10*a* rotatably supported below the process tray 8 at one side thereof and having a length substantially the same as the width of the process tray 8. A second pulley shaft 11*a* having a length shorter than that of the first pulley shaft 10*a* is rotatably supported below the center tray 8*b* at a position opposite to the first pulley shaft 10*a* (the other side of the center tray 8*b*).

The first pulley shaft 10*a* has four conveyance lower rollers 18 rigidly attached thereto, i.e., two rollers on a right side and the two other rollers on a left side of the sheet advancing in the sheet conveyance direction (i.e., an upper side and a lower side in FIG. 4). The conveyance lower rollers 18 have a hollow shape like a tire. A circumference of each conveyance lower roller 18 is exposed above a top surface of the process tray 8 through a cutout formed in one side of the process tray 8 (see also FIG. 6).

The first pulley shaft 10*a* is attached to first pulleys 10 having a diameter smaller than the conveyance lower rollers 18 through one-way clutches 75 transferring only counterclockwise rotation to the first pulleys 10. Second pulleys 11 are attached to both ends of the second pulley shaft 11*a* and have a diameter the same as that of the first pulley 10. The first pulley 10 and second pulley 11 are arranged between the center tray 8*b* and the right tray 8*a*, and between the center tray 8*b* and the left tray 8*c*.

Two endless conveyance belts 12 are placed between the first pulleys 10 and second pulleys 11. Accordingly, the rotation of the stepping motor 70 transferred to the first pulley shaft 10*a* through the on-way clutch 75 is transferred to the second pulley 11 only when the first pulleys 10 rotate counterclockwise, in other words, only when the conveyance belts 12 move in the arrow direction A in FIG. 4. When the first pulley shaft 10*a* rotates clockwise (when the conveyance belts 12 conveys in an arrow direction B in FIG. 4), the rotation is not transferred to the second pulleys 11.

Figure 5:
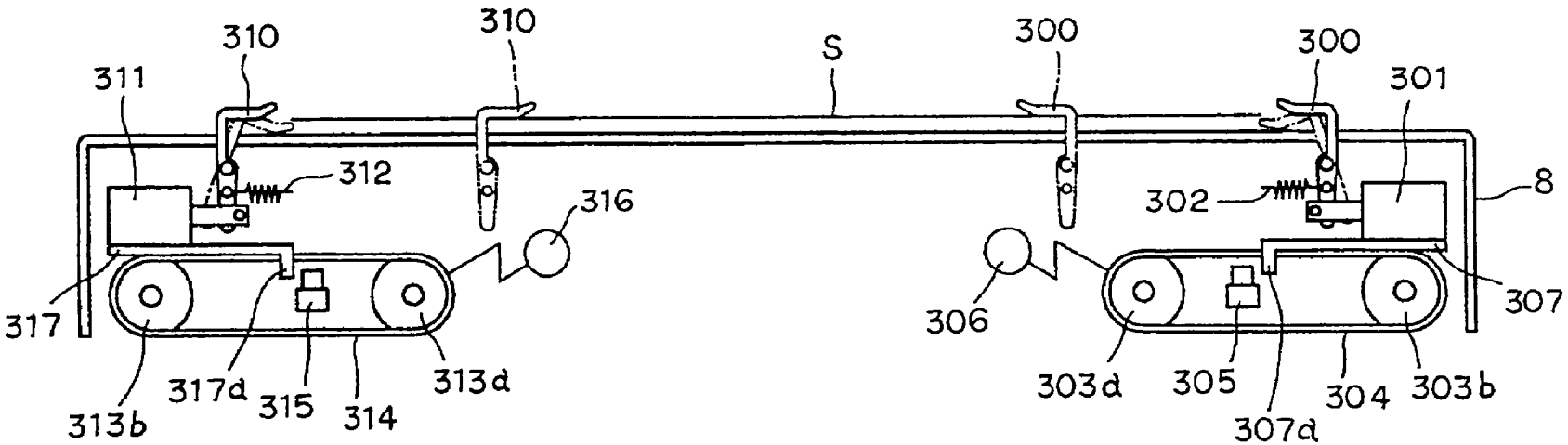
FIG. 5 is a side sectional view of the process tray of the sheet post-processing apparatus taken along line 5—5 in FIG. 4.

Slits are formed at the center portions of the right tray 8*a* and left tray 8*c*, and extend close to the alignment motors 14 in a vertical direction (perpendicular to the conveyance direction of the conveyance belt 12). As shown in FIG. 5, sheets pressing levers 300 and 310 for pressing the left and right edges of the sheets (a stack of sheets) placed on the process tray 8 are arranged so that the levers 300 and 310 slide in the slits.

The sheet pressing levers 300 and 310 are fixed to plungers of solenoids 301 and 311, respectively. The solenoids 301 and 311 are fixed to solenoid support plates 307 and 317. The solenoid support plate 307 is fixed to an endless belt 304 placed between a driving pulley 303*a* and a driven pulley 303*b*. The solenoid support plate 317 is fixed to an endless belt 314 placed between a driving pulley 313*a* and driven pulley 313*b*.

Blocking members 307*a*, 317*a* are arranged at end sides of the solenoid support plates 307, 317 close to the center tray 8*b* for blocking photo-receiving surfaces of HP detector sensors 305, 315 formed of an emitter-receptor integrated type sensor for detecting home positions of the sheet pressing levers 300, 310. The driving pulleys 303*a*, 313*a* are driven with stepping motors 306, 316 through gears (not shown). Accordingly, the sheet pressing levers 300, 310 are freely movable within the slits of the right tray 8*a* and left tray 8*c* as represented by phantom lines in FIG. 5 according to the sheet size (A3, A4, or A5 in this embodiment).

When the solenoids 301 and 311 are off, the sheet pressing levers 300, 310 are at positions where the sheet pressing levers 300, 310 do not push the sheets (as represented by solid lines in FIG. 5) with the urging force of the springs 302 and 312 via pivots. When the solenoids 301 and 311 are on, the sheet pressing levers 300 and 310 push the sheets against the urging force of the springs 302, 312 (as represented by projected lines in FIG. 5). The alignment plates 9 have slots at locations where the sheet pressing levers 300 and 310 pass, thereby eliminating mechanical interference therebetween.

As shown in FIG. 3, a paddle 17 is disposed below the conveyance path guide 7 and above the process tray 8. The paddle 17 rotates around an axis 17*a* for urging the sheet in the sheet conveyance direction. The paddle 17 is formed of an elastic material such as rubber having a certain elasticity, and includes integrally formed fins 17*b* radially extending from the axis 17*a* as the center thereof. As the sheets are discharged or collected into the process tray 8, the paddle 17 deforms elastically, thereby providing an appropriate urging force to the sheets in the sheet conveyance direction.

Figure 6:
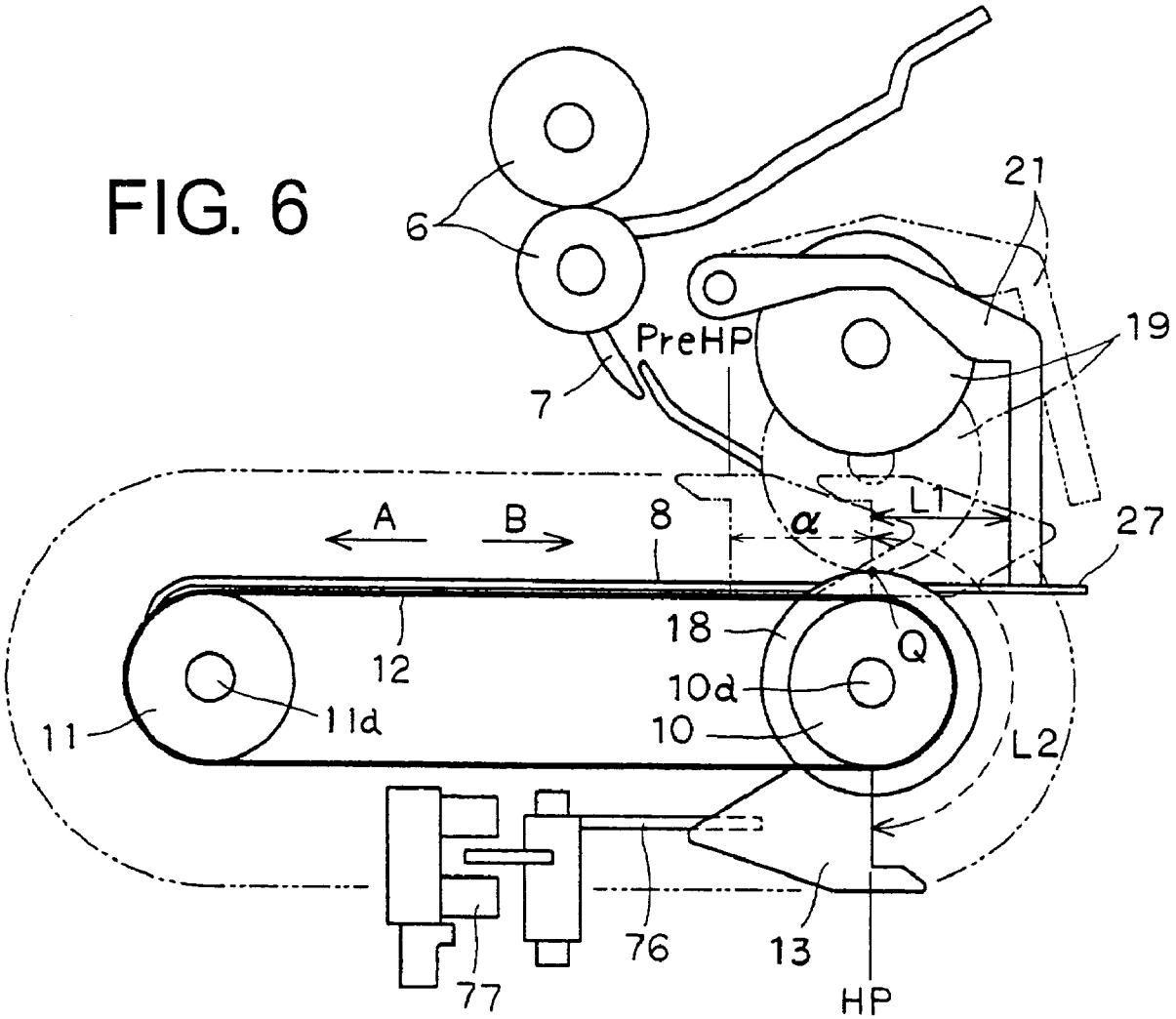
FIG. 6 is a side view around a conveyance belt of the process tray of the sheet post-processing device.

As shown in FIG. 6, a pushing claw 13 is attached to the conveyance belt 12 for abutting an edge of the sheet stack composed of a plurality of the sheets on the process tray 8 and pushing the sheet stack in the arrow direction A. The pushing claw 13 has a home position (also referred to as HP position), where an edge of the pushing claw 13 is located right below the first pulley shaft 10*a*. A detector arm 76 engaging the pushing claw 13 and an arm detector sensor 77 formed of an emitter-receptor integrated type are arranged below the conveyance belt 12 for detecting the HP position of the pushing claw 13 (also see FIG. 4).

A conveyance upper roller 19 is arranged above each of the conveyance lower rollers 18. The conveyance upper roller 19 moves between a contact position (a first position) where the conveyance upper roller 19 contacts the conveyance lower roller 18 at a contact point (nip) Q as represented by a phantom line in FIG. 6 and a spaced position (a second position) where the conveyance upper roller 19 is away from the conveyance lower roller 18. The conveyance upper roller 19 moves between the contact position and the spaced position through a cam (not shown), etc., and the conveyance upper roller 19 rotates with the stepping motor 70 (see FIG. 13) through a gear (not shown).

A first stack guide 27 having a plate shape is arranged on a tilted plane the same as that of the process tray 8 at downstream of the process tray 8 for supporting (hold) the sheet stack in cooperation with the process tray 8. A stopper 21 is arranged above the first stack guide 27 for restraining and aligning edges of the sheets. The sheets are urged downwardly in the sheet conveyance direction by their own weight on the tilted process tray 8 and first stack guide 27, and are further urged by the rotation of the paddle 17.

Figure 7:
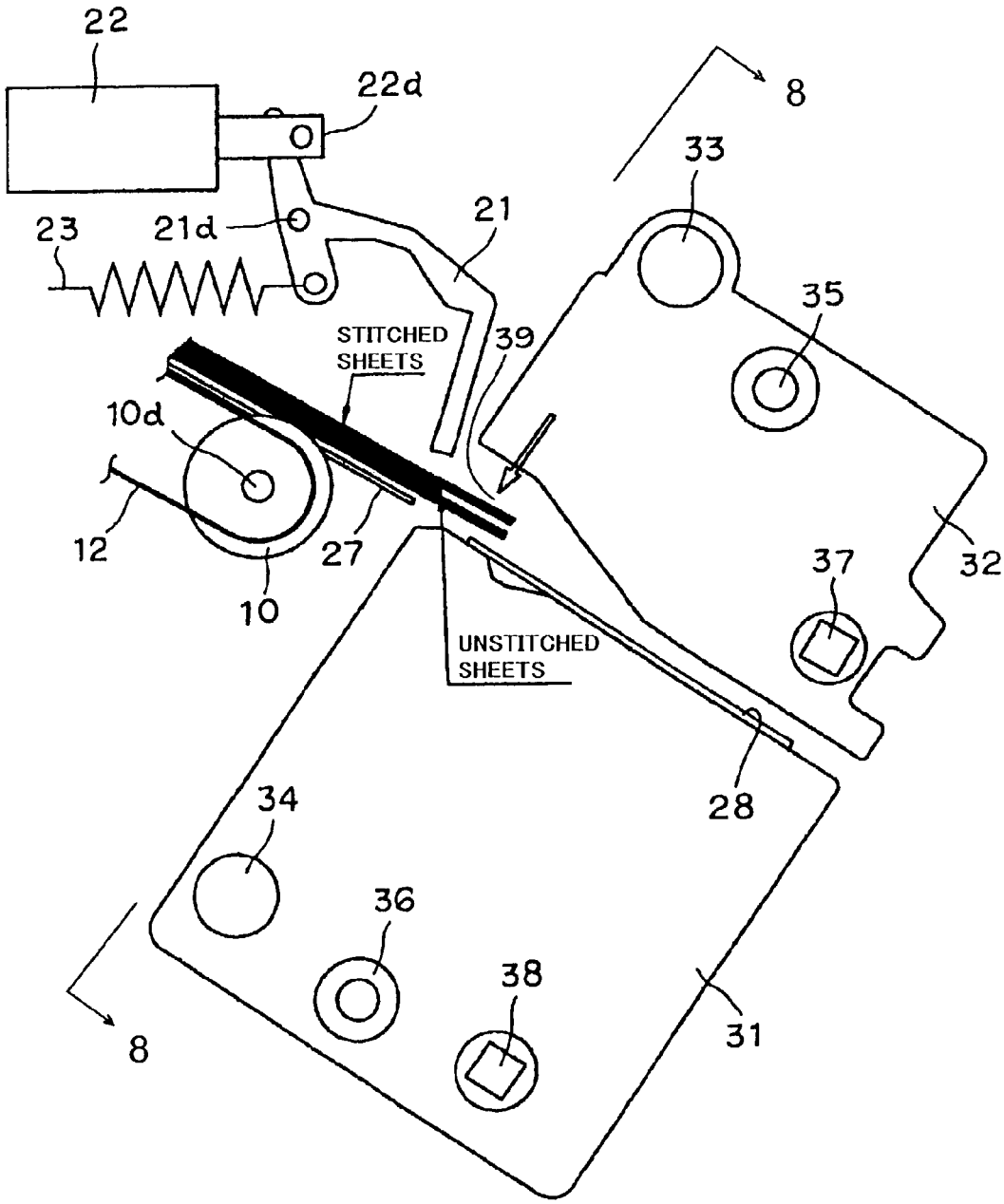
FIG. 7 is a side view around a stopper of the sheet post-processing device.

As shown in FIG. 7, the stopper 21 has a J-shaped cross section with an arm and a leg. One end of the arm is connected to a plunger 22*a* of a solenoid 22, and the other end of the arm is pulled by a spring 23 with a predetermined tension. Accordingly, in response to an on/off operation of the solenoid 22, the stopper 21 pivotally moves around a support shaft 21*a* located at the approximate center of the arm thereof between a restraining position represented by a solid line where a bottom surface of the leg (an end of the leg) abuts against a top surface of the first stack guide 27 and a retraction position represented by a phantom line where the stopper 21 is retracted from the top surface of the first stack guide 27. The stopper 21 normally stays at the retraction position (with the solenoid 22 remaining in the off state) represented by the solid line.

The pushing claw 13 can move in a direction represented by an arrow A in FIG. 6 in a normal state (with the conveyance upper roller 19 at the spaced position and the stopper 21 at the retraction position). L1 represents a distance between the end face of the pushing claw 13 and the stopper 21 when the end face of the pushing claw 13 is positioned at the contact point Q between the conveyance lower roller 18 and the conveyance upper roller 19. L2 represents a distance from the end face of the pushing claw 13 at the HP position to the contact point Q. In this case, it is arranged that L1 is smaller than L2.

As shown in FIG. 6, the lower end portion of the conveyance path guide 7 extending below the discharge roller pair 6 engages a fixed guide pressing the sheet discharged into the process tray 8 to prevent the edge of the sheet from being lifted above the conveyance upper roller 19.

As shown in FIGS. 3 and 7, the stapler unit 30 is arranged at downstream of the offset unit 20. The stapler unit 30 includes a head assembly 31 and anvil assembly 32. The head assembly 31 has a staple cartridge disposed below a conveyance path 39 for conveying the stack of the sheets to drive a staple. The anvil assembly 32 is disposed above the head assembly 39 for receiving tips of the staple driven from the head assembly 31 to fold the staple. A second stack guide 28 is arranged in the conveyance path 39 above the head assembly 31 at a position away from an insertion head of the head assembly 31 that drives the staple, and has a tilted plane the same as that of the first stack guide 27. The stapler unit 30 is formed in a unit as represented by a phantom line in FIG. 3, and can be drawn toward front in FIGS. 3 and 7 for replenishing staples.

Figure 8:
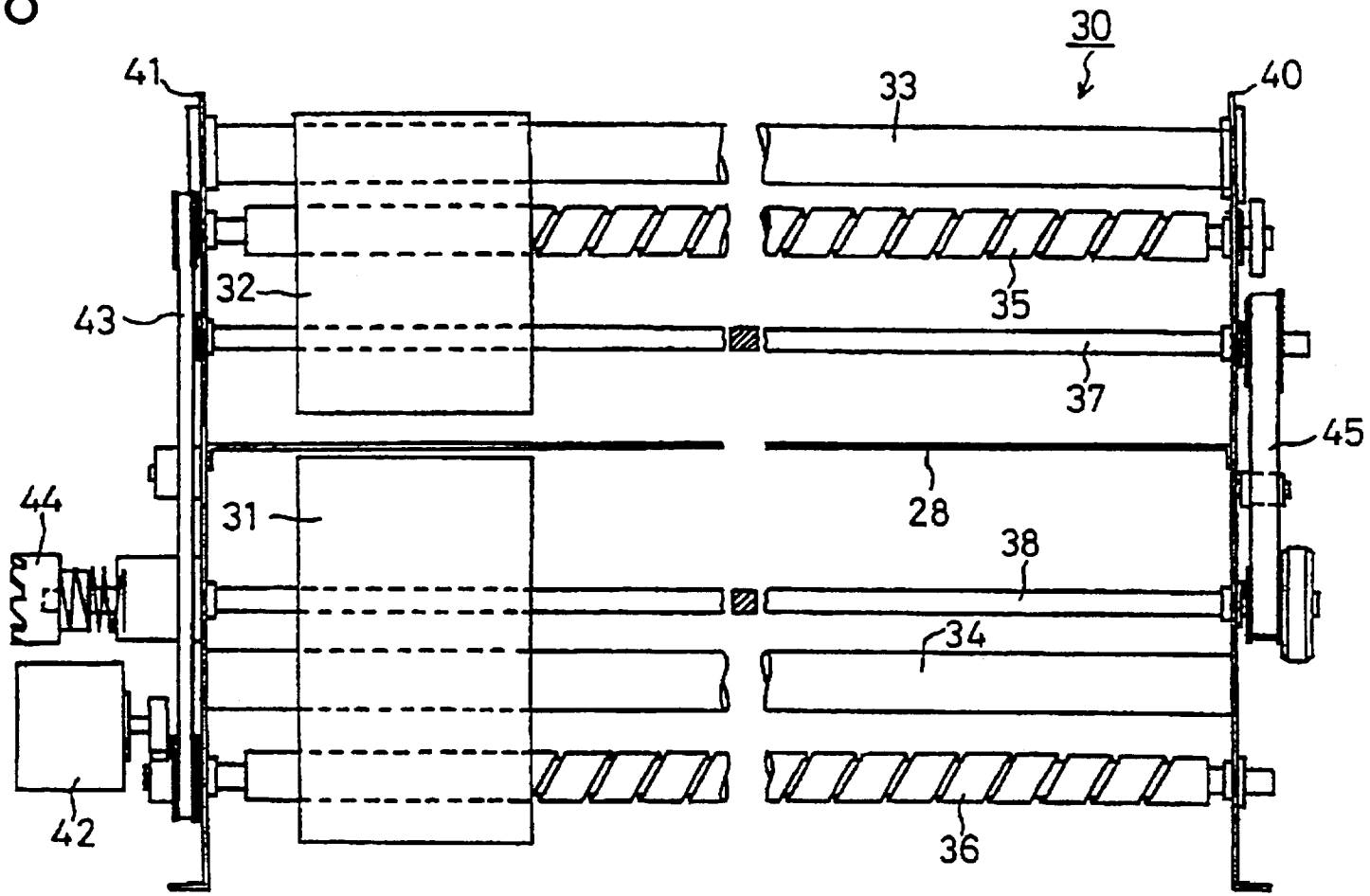
FIG. 8 is a front view of a stapler unit of the sheet post-processing device viewed from line 8—8 in FIG. 7.

As shown in FIG. 8, the stapler unit 30 includes guide rods 33, 34 between left and right unit frames 40, 41 for supporting and guiding the head assembly 31 and anvil assembly 32 in a direction perpendicular to the sheet conveyance direction; guide screw shafts 35, 36 having helical screws thereon for sliding the head assembly 31 and anvil assembly 32 in the direction perpendicular to the sheet conveyance direction; and an anvil driving shaft 37 and head driving shaft 38 having a rectangular cross section for allowing the head assembly 31 and anvil assembly 32 to perform a staple driving operation and staple folding operation, respectively.

The head assembly 31 and anvil assembly 32 engage the guide screw shafts 36, 35. When the guide screw shafts 36, 35 rotate, the head assembly 31 and anvil assembly 32 move leftward or rightward in FIG. 8. A stapler slide motor 42 is arranged at the outside of the unit frame 41 for rotating the guide screw shaft 36 in a forward or reverse direction through gears. At the same time, the rotation of the stapler slide motor 42 is transferred to the anvil assembly 32 through a timing belt 43 placed around pulleys fixed to the guide screw shafts 36, 35 at the outside of the unit frame 41.

A stapling/folding stepping motor 170 (see FIG. 13) transfers the rotation thereof to the head driving shaft 38 through a coupling device 44 arranged at the outside of the unit frame 41. The rotation of the stapling/folding motor 170 is also transferred to the anvil assembly 32 through a timing belt 45 placed around pulleys fixed to the head driving shaft 38 and anvil driving shaft 37 at the outside of the unit frame 40. In this arrangement, the head assembly 31 and anvil assembly 32 move in synchronization with each other in the direction perpendicular to the sheet conveyance direction while maintaining a vertical alignment therebetween. The stapler slide motor 42 is controlled to move the head assembly 31 and anvil assembly 32 to drive the staple into the sheets at an appropriate position in accordance with the width of the sheets.

As shown in FIG. 3, the folding unit 50 is formed in a unit represented by a phantom line and arranged at downstream of the stapler unit 30. Similar to the stapler unit 30, the folding unit 50 is detachable from the sheet post-processing device 2.

A general construction of the folding unit 50 is first described. A stack conveyance upper roller 51 and stack conveyance lower roller 52 are arranged at an entrance of the folding unit 50 for nipping and conveying the sheet stack in a downstream direction. A stack conveyance guide 53 is arranged at downstream of the stack conveyance upper roller 51 and stack conveyance lower roller 52 for guiding the sheet stack fed from the roller pair further in a downstream direction. An edge detector sensor 54 formed of an emitter-receptor integrated type sensor is arranged in the sheet stack conveyance path of the stack conveyance guide 53 for detecting a forward edge of the sheet stack. According to a signal of detecting the forward edge of the sheet stack, a controller (described later) allows the stack conveyance upper roller 51 to press against the stack conveyance lower roller 52, and controls to set a folding position of the sheet stack in the sheet conveyance direction.

Figure 10A:
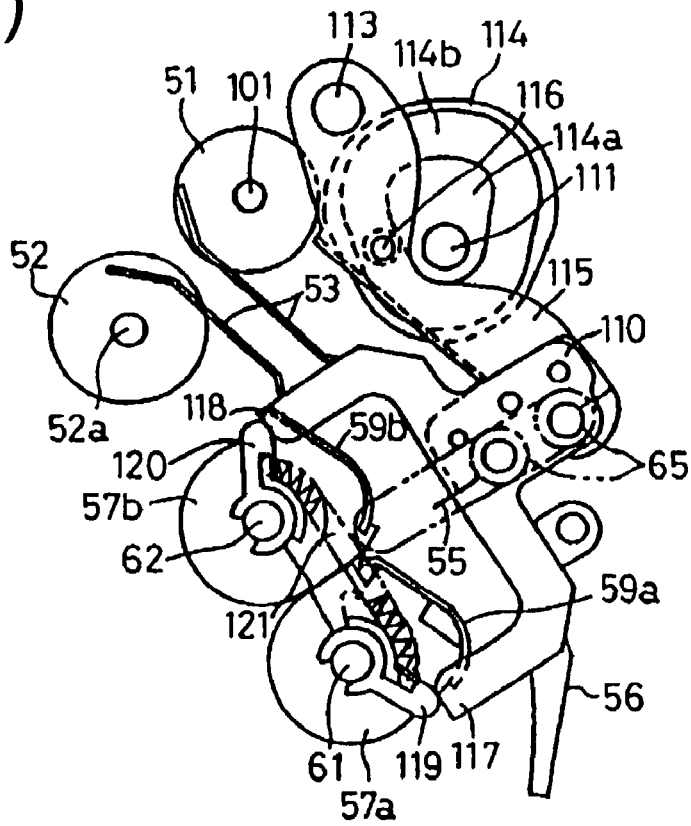
FIG. 10(A) is a side view of a folding mechanism of the folding unit.
Figure 10B:
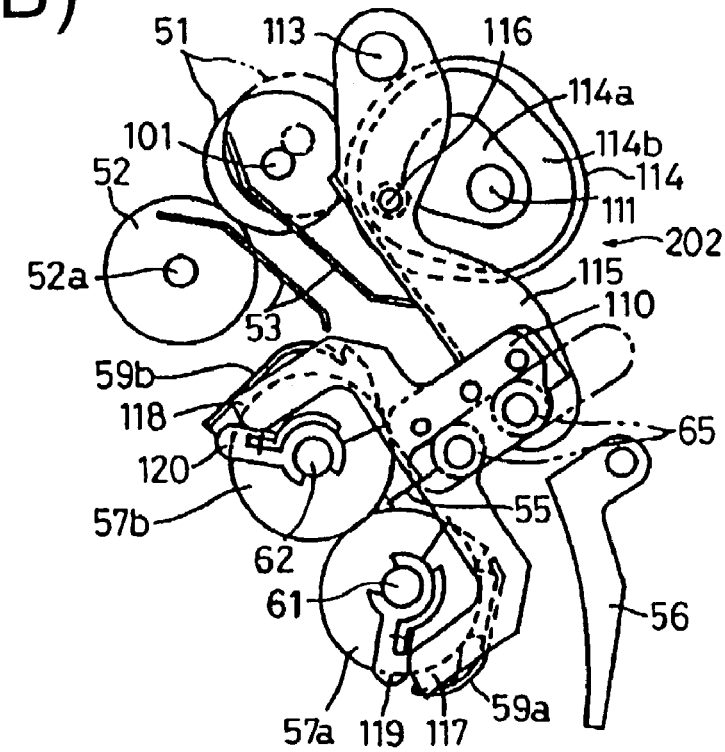
FIG. 10(B) is a side view of the folding mechanism in a folding operation of the folding mechanism.

The stack conveyance upper roller 51 moves between a position represented by a solid line where the stack conveyance upper roller 51 is pressed against the stack conveyance lower roller 52 and a spaced position where the stack conveyance upper roller 51 is away from the stack conveyance lower roller 52 (as represented by a projected line in FIG. 10(B)). The stack conveyance upper roller 51 remains at the spaced position away from the stack conveyance lower roller 52 until the edge detector sensor 54 detects the forward edge of the sheet stack. The rollers 51 and 52 are pressed against with each other when the edge detector sensor 54 detects the forward edge of the sheet stack.

A pair of rollers 57*a* and 57*b* is arranged below the stack conveyance guide 53, and is respectively driven and pressed against each other in a direction perpendicular to the sheet stack conveyance direction for folding the sheet stack. Each of the rollers 57*a* and 57*b* has a diameter so that each roller rotates at least one revolution during the folding of the sheet stack (a diameter of 40 mm, for example).

A pushing plate 55 is arranged at downstream of the stack conveyance guide 53 in a direction perpendicular to the sheet stack conveyance direction. An edge of the pushing plate 55 moves close to the contact position of the folding rollers 57*a*, 57*b* to push the sheet stack into the contact position between the folding rollers 57*a*, 57*b*. The pushing plate 55 is made of stainless steel, and has a thickness of 0.25 mm at the end thereof.

Backup guides 59*a* and 59*b* having semicircular shapes in cross section are arranged above the folding rollers 57*a* and 57*b* for assisting the stack conveyance guide 53 to guide the sheet stack. As will be described later, the backup guides 59*a* and 59*b* move when the pushing plate 55 moves up and down in a direction perpendicular to the sheet stack conveyance direction. When the edge of the pushing plate 55 moves close to the nip between the folding rollers 57*a* and 75*b*, the backup guides 59*a* and 59*b* move and open circumferences thereof relative to the sheet stack.

Figure 9:
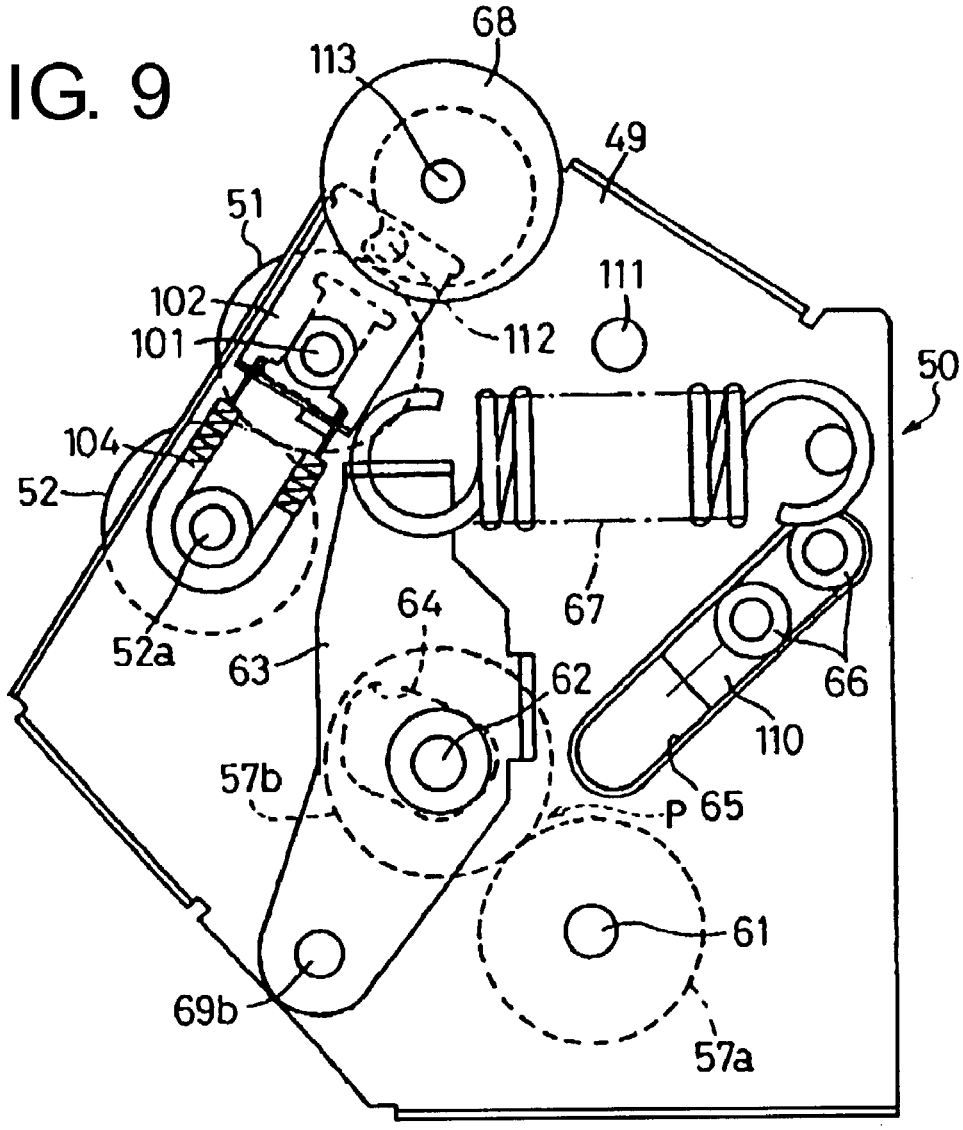
FIG. 9 is a side view illustrating a folding unit of the sheet post-processing device.

The folding unit 50 is described below in detail. As shown in FIG. 9, the folding rollers 57*a* and 57*b* are fixed to folding roller driving shafts 61 and 62 pivotally and rotatably supported on a unit frame 49. A bow-shaped (boomerang-like shape) roller holder 63 is attached to the folding roller driving shaft 62 so that the folding roller driving shaft 62 passes through the center of the folding roller holder 63. The folding roller holder 63 has one end rotatably supported on a fixed shaft 69*b* fixed to the unit frame 49, and the other end pulled by a pulling spring 67 fixed to the unit frame 49 with a pulling force of about 49 N (5 kgf).

The unit frame 49 has a guide hole 64 for allowing the folding roller driving shaft 62 to move therein when the folding roller holder 63 rotates. Therefore, when the folding rollers 57*a* and 57*b* fold the sheet stack, the pulling spring 67 applies a constant pressure on the sheet stack to assure the folding operation.

The pushing plate 55 projects from a roll 66 movably retained in a support holder 110. The unit frame 49 has a pushing plate guide slot 65 for guiding the roll 66 in the support holder 110. The pushing plate 55 moves toward the nip P of the folding rollers 57*a* and 57*b* while being guided by the pushing plate guide slot 65.

An upper roller shaft 101 of the stack conveyance upper roller 51 and lower roller shaft 52*a* of the stack conveyance lower roller 52 are supported on the unit frame 49 for conveying the sheet stack to the folding unit 50. The stack conveyance upper roller 51 and stack conveyance lower roller 52 need to be spaced each other until the sheet stack is brought into the folding unit 50. For this reason, it is arranged that the stack conveyance upper roller 51 is situated at a position away from the stack conveyance lower roller 52 with the following mechanism.

Specifically, the upper roller shaft 101 is supported on a bearing holder 102. A cam follower 112 projects from a top end portion of the bearing holder 102. The cam follower 112 engages an upper roller movement cam 68 rotatably supported on the unit frame 49. A pulling spring 104 having a pulling force of approximately 2.9 N (about 300 gf) extends between the lower ends of the bearing holder 102 and the lower roller shaft 52*a* to press the stack conveyance upper roller 51 against the stack conveyance lower roller 52. The bearing holder 102 is lifted against the pulling spring 104 when the upper roller movement cam 68 rotates. Accordingly, the stack conveyance upper roller 51 moves between the position spaced apart from the stack conveyance lower roller 52 and the contact position.

As shown in FIGS. 10(A) and 10(B), the folding unit 50 includes a cam plate 114 having a cam 114*a* for moving the pushing plate 55. The cam plate 114 is fixed to a cam driving shaft 111 pivotally supported on the unit frame 49. A cam timing of the cam plate 114 is set so that the pushing plate 55 moves about twice as fast as the folding rollers 57*a* and 57*b*, and so that the pushing plate 55 does not contact both edges of the sheet stack even if the pushing plate 55 pushes twice or more.

It is arranged that the movement speed of the pushing plate 55 is predetermined times fast as the conveyance speed of the folding rollers 57*a* and 57*b*. Therefore, a period of time for the stitched position of the sheet stack conveyed by the folding rollers 57*a* and 57*b* to reach the nip P becomes substantially equal to a period of time for the pushing plate 55 to reach the nip of the folding rollers 57*a* and 57*b* after the pushing plate 55 contacts the stitching position of the sheet stack. Thus, the folding rollers 57*a* and 57*b* and pushing plate 55 move in synchronization.

It is also arranged that the timing of the movement of the pushing plate 55 after a double pushing is mechanically set so that the pushing plate 55 does not contact both edges of the folded sheet stack having a predetermined size. The movement timing of the pushing plate 55 is set in this way, and the folding timing of the folding rollers 57*a* and 57*b* is also set with the roller diameter thereof as a predetermined value. Specifically, the folding operation is performed at the two timings when the sheet stack is folded. Accordingly, regardless of the size of the sheet, it is possible to prevent the pushing plate 55 from touching both edges of the sheet.

An actuator arm 115 having a bow shape in cross section is pivotally supported at one end thereof on a shaft 113 of the upper roller movement cam 68. The support holder 110 is fixed to the other end of the actuator arm 115 as a pivoting end. The cam plate 114 has a cam groove 114*b*. A cam follower 116 projecting from an approximate center of the actuator arm 115 is inserted in the cam groove 114*b*. When the cam plate 114 rotates, the cam 114*a* presses the cam follower 116 to lift the actuator arm 115. The pushing plate 55 fixed to the actuator arm 115 is thus movable between a position for pushing the sheet stack and a standby position.

Levers 119 and 120 are rotatably supported on the folding roller driving shafts 61 and 62 of the folding rollers 57*a* and 57*b*, respectively. Backup guides 59*a* and 59*b* are attached to the levers 119 and 120 for covering the circumferences of the folding rollers 57*a* and 57*b*, and are rotatably supported on the folding roller driving shafts 61 and 62 with respect to the circumferences of the folding rollers 57*a* and 57*b*. The backup guides 59*a* and 59*b* are pulled to each other by a spring 121. Ends of the levers 119 and 120 engage and are supported on end portions 117 and 118 branched from the support holder 110.

A guide 56 is disposed below the support holder 110 for shifting the stack conveyance direction of the sheet stack nipped between and conveyed by the stack conveyance upper roller 51 and stack conveyance lower roller 52 to a downward direction. The guide 56 guides the sheet stack so that the forward edge of the sheet stack is suspended downward in a sheet stack passage 58 (see FIG. 3) formed between a device frame 2A and the folding unit 50.

As shown in FIG. 10(A), when the stack conveyance upper roller 51 is away from the stack conveyance lower roller 52, the backup guides 59*a* and 59*b* are positioned to cover the circumferences of the folding rollers 57*a* and 57*b* at a side of the conveyance passage. Thus, the backup guides 59*a* and 59*b* function as an extension from the lower stack conveyance guide 53, thereby assisting the stack conveyance guide 53 to convey the sheet.

As shown in FIG. 10(B), when the operation of folding the sheet stack is performed, the support holder 110 is lowered toward the nip P between the folding rollers 57*a* and 57*b*. The levers 119 and 120 are lowered by the end portions 117 and 118, and the backup guides 59*a* and 59*b* rotate around the folding roller driving shafts 61 and 62 against the spring 121, thereby allowing the circumferences of the folding rollers 57*a* and 57*b* to contact the sheet stack.

The drive transfer system of the folding unit 50 is divided into a stack conveyance roller driving subsystem for driving (rotating and moving away) the stack conveyance upper roller 51 and stack conveyance lower roller 52, and a folding roller/pushing plate driving subsystem for rotating the folding rollers 57*a* and 57*b* while moving the pushing plate 55. These subsystems are arranged at a deep side of the unit frame 49 as shown in FIG. 9.

Figure 11:
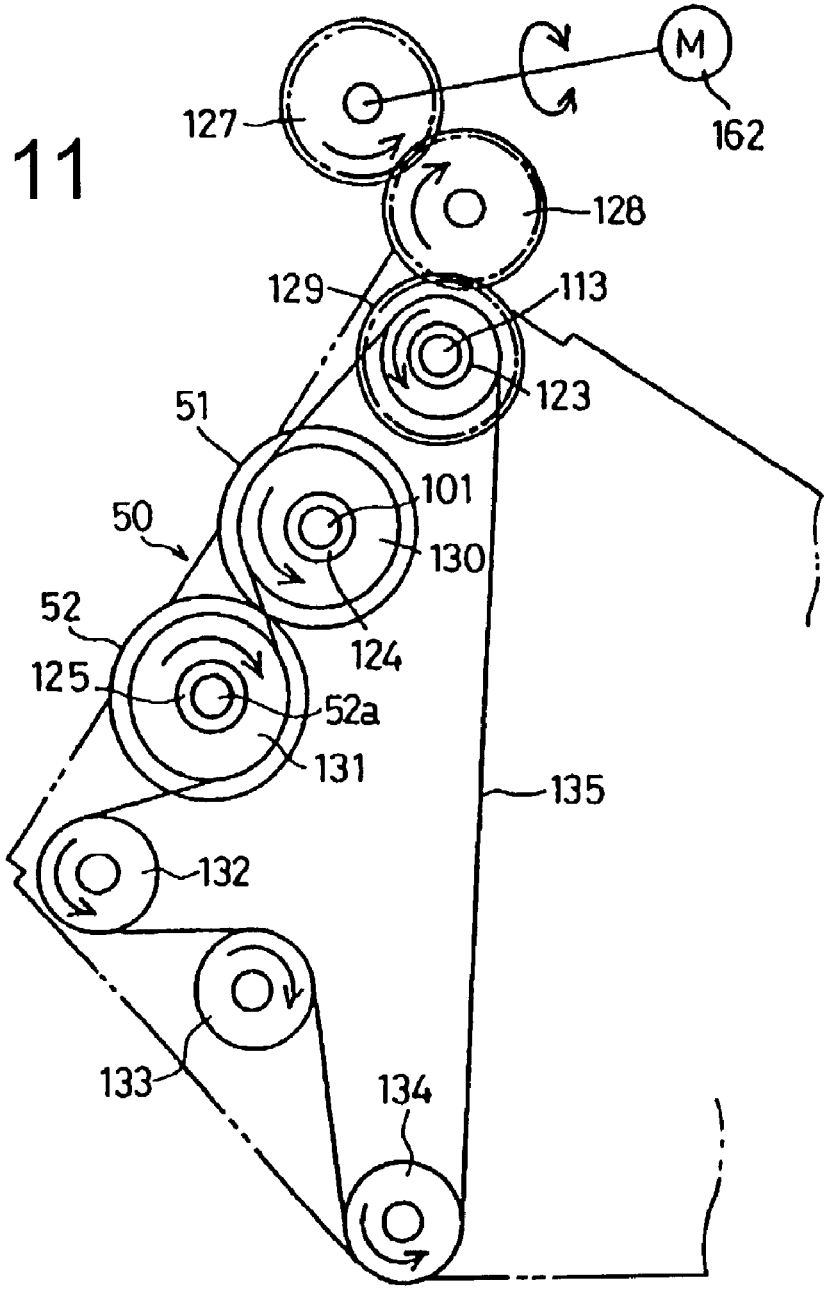
FIG. 11 is a side view of a driving system of a conveyance roller of the folding unit.

As shown in FIG. 11, a conveyance motor 162 formed of a stepping motor capable of rotating in forward and reverse directions drives the stack conveyance roller driving subsystem. The rotation of the conveyance motor 162 is transferred to a gear pulley 129 through gears 127 and 128. A one-way clutch 123 is interposed between the gear pulley 129 and the shaft 113 driving the upper roller movement cam 68. Accordingly, with the one-way clutch 123, the upper roller movement cam 68 rotates to move the stack conveyance upper roller 51 vertically only when the gears 127 and 128 rotate in directions opposite to the arrow directions in FIG. 11.

The rotation of the gear pulley 129 is transferred to the upper roller shaft 101 and lower roller shaft 52*a* through a timing belt 135 placed around pulleys 130 and 131. A one-way clutch 124 is interposed between the pulley 130 and the upper roller shaft 101, and a one-way clutch 125 is interposed between the pulley 131 and the lower roller shaft 52*a*. Accordingly, the upper roller shaft 101 and lower roller shaft 52*a* rotate only when the pulleys 130 and 131 rotate in the arrow directions in FIG. 11. The timing belt 135 is also placed around pulleys 132, 133, and 134.

When the gears 127 and 128 rotate in the arrow directions in FIG. 11, the stack conveyance upper roller 51 and stack conveyance lower roller 52 rotate in directions to convey the sheet stack into the folding unit 50. When the gears 127 and 128 rotate in the directions opposite to the arrow directions in FIG. 11, the upper roller movement cam 68 rotates, thereby spacing the stack conveyance upper roller 51 away from the stack conveyance lower roller 52. A controller 149 (described later) controls these operations when sensors detect flag pegs (not shown) fixed to a shaft 132 of a pulley 133.

Figure 12:
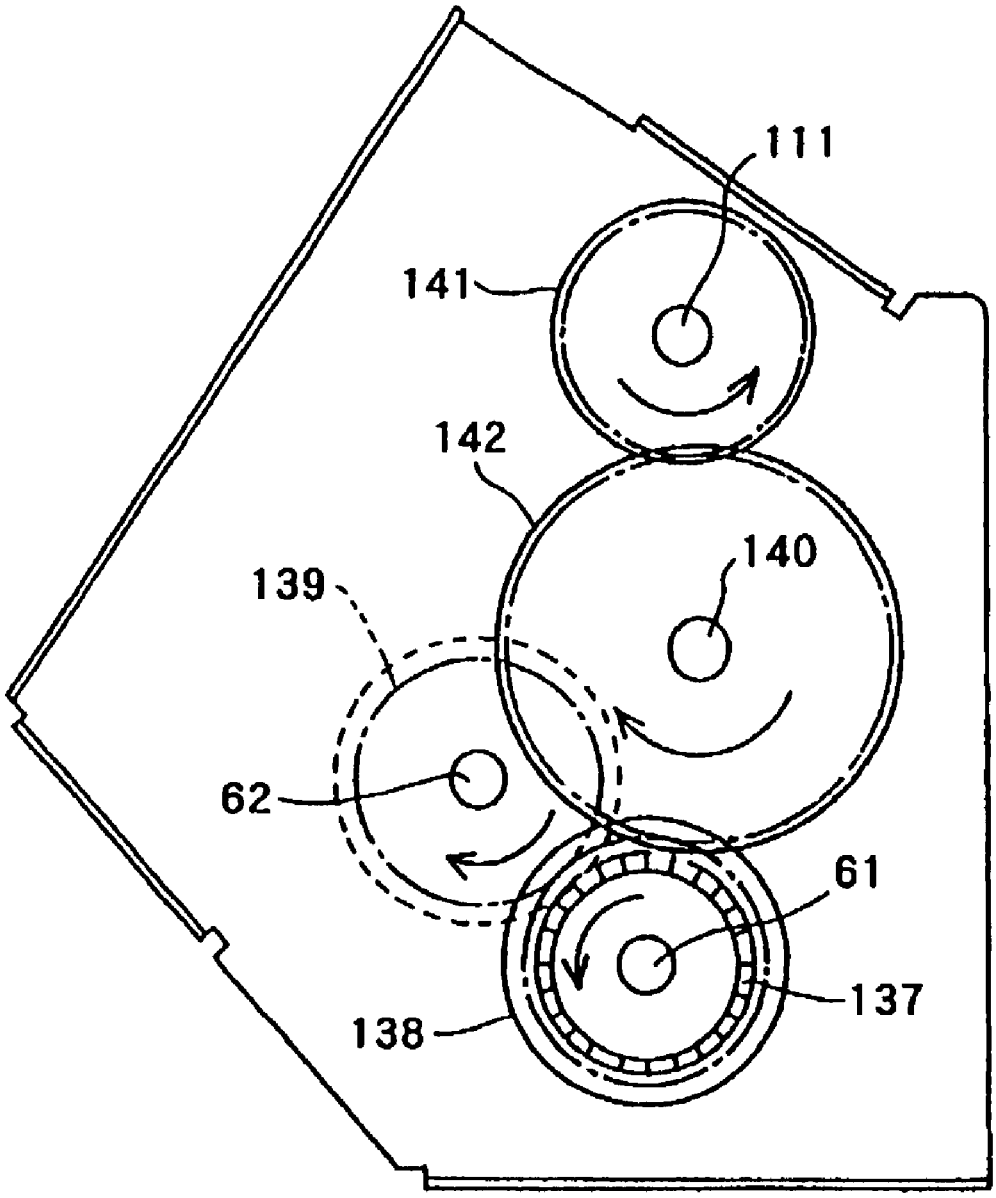
FIG. 12 is a side view of a driving system of a folding roller and pushing plate in the folding unit.

As shown in FIG. 12, the stapling/folding motor 170 drives the folding roller/pushing plate driving subsystem (see FIG. 13) through a coupling device 137 attached to the folding roller driving shaft 61. The stapling/folding motor 170 drives the coupling device 44 of the stapler unit 30 shown in FIG. 8 with the forward rotation, or drives the coupling device 137 with the reverse rotation through a driving and transfer system (not shown).

The rotation of the coupling device 137 is transferred to a gear 139 rigidly fixed to the folding roller driving shaft 62 through the gear 138 rigidly fixed to the folding roller driving shaft 61. Furthermore, the rotation of the gear 138 is transferred to the cam driving shaft 111 of the cam plate 114 through a gear 142 rotatable around a shaft 140 and a gear 141 engaging the gear 142. The cam plate 114 activates the actuator arm 115 to move the pushing plate 55. The controller (described later) determines a position of the cam plate 114 when a flag peg (not shown) attached to the cam driving shaft 111 is detected by a sensor.

As shown in FIG. 3, a folded sheet stack discharge stacker 80 is arranged at downstream of the folding unit 50 at a bottom portion of the sheet post-processing device 2. The folded sheet stack discharge stacker 80 has a tilted plane opposite to those of the offset unit 20, stapler unit 30, and stapler unit 30, and stocks the sheet stack folded by the folding unit 50. A folded sheet pressure member 81 having one end pivotally supported is arranged above the folded sheet stack discharge stacker 80. The folded sheet pressure member 81 presses the discharged sheet stack using an urging force of a spring or the like in cooperation with the force of gravity of the sheet stack working along the tilted plane of the folded sheet stack discharge stacker 80.

A stack container 88 having a box shape is arranged below the folded sheet stack discharge stacker 80 for holding a stack of unfolded sheets. The sheet stack passage 58 extends near the box-like stack container 88. A driving roller 84 and driven roller 83 are arranged in the middle of the sheet stack passage 58. The driving roller 84 is movable through a cam mechanism (not shown) between a contact position where the driving roller 84 abuts against the driven roller 83 and a spaced position where the driving roller 84 is away from the driven roller 83. An edge detector sensor 85 formed of an emitter-receptor integrated type sensor is arranged below the driving roller 84 and driven roller 83 for detecting the forward edge of the sheet stack.

A lifting tray 90 is arranged on a sidewall of the device frame 2A opposite to the digital copying apparatus main unit 1. The lifting tray 90 moves in a vertical direction with respect to the device frame 2A. A lifting tray support 92 supports the lifting tray 90. A lifting tray motor 155 formed of a stepping motor capable of rotating in a forward and reverse directions (see FIG. 13) moves the lifting tray support 92 vertically through a belt (not shown). The lifting tray 90 is raised and lowered between an upper limit position represented by a solid line and a lower limit position represented by a phantom line in FIG. 3.

The lifting tray 90 includes an auxiliary tray 91, and the auxiliary tray 91 is pulled out from the lifting tray 90 to place a large-size sheet thereon. A sheet surface sensor 93 is arranged below the second pulley 11 of the offset unit 20 for detecting a top surface of the sheets on the lifting tray 90. A rear edge guide 94 is arranged on the sidewall of the lifting tray 90 of the device frame 2A for guiding the rear edge of the sheet on the lifting tray 90 when the lifting tray 90 is raised or lowered.

When the stapler unit 30 does not stitch, the sheet stack is collected on the lifting tray 90. When the folding unit 50 folds the sheet stack, the sheet stack is collected on the folded sheet stack discharge stacker 80. When the stapler unit 30 stitches, the sheet stack is collected on one of the lifting tray 90 and stack container 88 in accordance with a command from the touch panel 248 input by the operator or a command from the personal computer 210.

Figure 13:
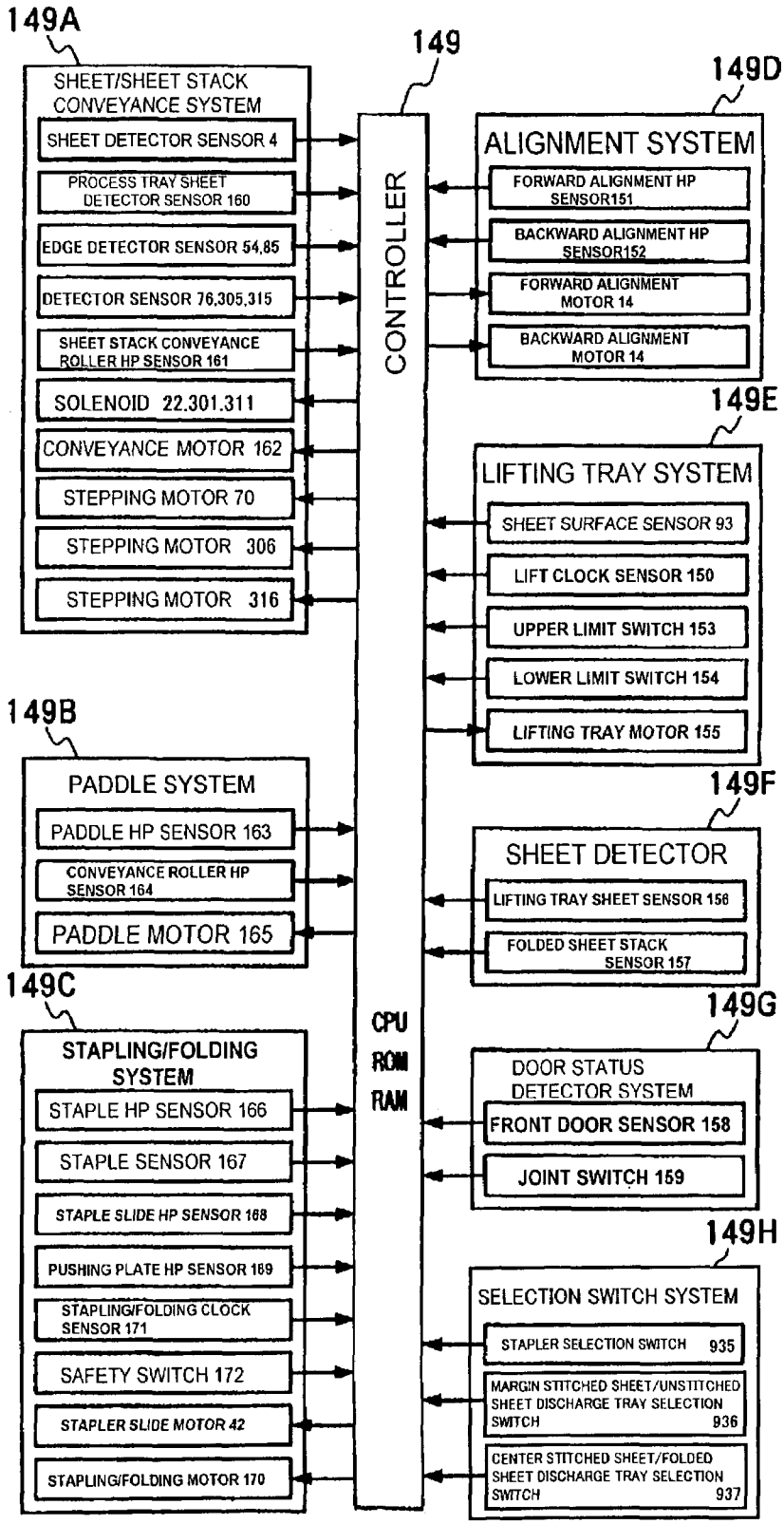
FIG. 13 is a block diagram illustrating a relationship among a controller, sensors and actuators of the sheet post-processing device.

As shown in FIG. 13, a controller 149 includes a central processing unit (CPU); a ROM for storing a program to be executed by the CPU and program data beforehand; a RAM for functioning as a work area for the CPU, and storing control data received from a controller 950 in the digital copying apparatus main unit 1 (see FIG. 2); and an interface. The controller 149 controls a sheet/sheet-stack conveyance system 149A, paddle system 149B, stapling/folding system 149C, alignment system 149D, lifting tray system 149E, sheet detector system 149F, door status detector system 149G, and selection switch system 149H. In FIG. 13, there are two identical components. One of two identical components positioned forward in FIG. 13 is referred to as a "front" component, and the other component positioned rear is referred to as a "rear" component as referred to FIG. 3.

The sheet/sheet-stack conveyance system 149A, functioning as an input to the controller 149, works for the conveyance of the sheets and sheet stack. The sheet/sheet-stack conveyance system 149A includes a sheet detector sensor 4 for detecting the sheet on the conveyance guide 3; edge detector sensors 54 and 85 for detecting the edge of the sheet stack; an arm detector sensor 77 for detecting the HP position of the pushing claw 13; HP position detector sensors 305 and 315 for detecting the home positions of the sheet pressing levers 300, 310, respectively; and a sheet stack conveyance roller HP sensor 161 for detecting the home position of the stack conveyance upper roller 51 when the stack conveyance upper roller 51 is away from the stack conveyance lower roller 52.

Output components of the controller 149 include the solenoid 22 for positioning the stopper 21 at one of the restraining position and retraction position; solenoids 301 and 311 for pressing the sheets on the right tray 8*a* and left tray 8*c*; the conveyance motor 162 for driving respectively the conveyance roller pair 5, discharge roller pair 6, stack conveyance upper roller 51, and stack conveyance lower roller 52 while rotating the upper roller movement cam 68 to move the stack conveyance upper roller 51; the stepping motor 70 for moving the conveyance lower roller 18, conveyance upper roller 19, and conveyance belt 12; and stepping motors 306 and 307 for moving the sheet pressing levers 300 and 310. The conveyance motor 162 and stepping motor 70 are controlled through motor drivers, and the solenoid 22 is controlled through a solenoid controller. The motor drivers and the solenoid controller are not shown in FIG. 13 (the same is true for the following systems).

The paddle system 149B includes, as input components thereof, a paddle HP sensor 163 for detecting a position of rotation of the paddle 17, and a conveyance roller HP sensor 164 for detecting a position of the conveyance upper roller 19 away from the conveyance lower roller 18, and as an output component, a paddle motor 165 for driving the paddle 17.

The stapling/folding system 149C includes, as input components thereof, a staple HP sensor 166 for detecting a completion of preparation of the head assembly 31 and the anvil assembly 32 for driving and folding a staple; a staple sensor 167 for detecting that a staple is set in the head assembly 31; a staple slide HP sensor 168 for detecting that the head assembly 31 and anvil assembly 32 are placed at the initial positions thereof in the sheet conveyance direction; a pushing plate HP sensor 169 for detecting the home position of the pushing plate 55; a clock sensor 171 for detecting the direction of rotation of the stapling/folding motor 170 to switch the rotation thereof to switch between staple unit driving and folding unit driving; and a safety switch 172 for detecting that the stapler unit 30 and folding unit 50 are enabled for operation.

The stapling/folding system 149C also includes, as output components thereof, the stapler slide motor 42 for rotating the guide screw shaft 36 to drive the head assembly 31 and anvil assembly 32 in a direction perpendicular to the sheet conveyance direction; and a stapling/folding motor 170 for driving the coupling device 44 of the stapler unit 30 in the forward rotation, and driving the coupling device 137 of the folding unit 50 in the reverse rotation.

The alignment system 149D includes, as input components, a forward alignment HP sensor 151 and backward alignment HP sensor 152 for detecting the home position of the alignment plates 9 to align both edges of the sheet on the process tray 8, and as an output component, forward and backward alignment motors 14 for moving the alignment plates 9. In the alignment motors 14, it is possible to set an amount of shifting in a direction perpendicular to the sheet and sheet stack conveyance direction.

The lifting tray system 149E includes, as an output component, the lifting tray motor 155 for moving the lifting tray 90, and as input components, the sheet surface sensor 93 for detecting the surface of the top sheet on the lifting tray 90, a lift clock sensor 150 for detecting an amount of rotation of the lifting tray motor 155, and upper limit switch 153 and lower limit switch 154 for limiting a range of lifting motion of the lifting tray 90.

The sheet detector system 149F includes a lifting tray sheet sensor 156 for detecting the sheet stack on the lifting tray 90 and that the lifting tray 90 and folded sheet stack discharge stacker 80 hold the sheet or the sheet stack, and a folded sheet stack sensor 157 for detecting the sheet stack on the folded sheet stack discharge stacker 80. The sensors 157 and 158 detect the sheet in the sheet post-processing device 2 to alert an operator to the presence of the sheet or the sheet stack when the sheet stack remains at startup or the sheet stack is not removed for a predetermined period.

The door status detector system 149G detects the status of a door attached to the device frame 2A, and determines whether the sheet post-processing device 2 can be mounted to the digital copying apparatus main unit 1. The door status detector system 149G includes a front door sensor 158 and joint switch 159 for detecting whether the sheet post-processing device 2 is properly attached on the digital copying apparatus main unit 1.

The selection switch system 149H includes, as input components, a stapler selection switch 935 for selecting a stitching process to be performed on the sheet stack regardless of whether the stitching process is for saddle stitching or side stitching; a side stitched/unstitched sheet discharge tray selection switch 936 for selecting the discharging of a side stitched sheet or unstitched sheet to the lifting tray 90; and a saddle stitched and folded sheet discharge tray selection switch 937 for selecting the discharging of saddle stitched and folded sheets (stack of sheets) to the folded sheet stack discharge stacker 80. Although the touch panel 248 is used to select the process mode, the user may manually press one of these switches to select a desired process mode while visually checking the selected mode.

An operation of the digital copying apparatus 1A according to this embodiment will be explained next. Typical sheet post-processing modes of the digital copying apparatus 1A are explained in detail below. The sheet post-processing modes of the digital copying apparatus 1A include (1) a non-stapling mode in which the sheet stack is placed on the lifting tray 90 without performing the stitching operation thereon, (2) a side stapling mode in which the sheet stack is placed on one of the lifting tray 90 and box-like stack container 88 after performing the stitching operation at least on one position at an edge portion of the sheet stack in the direction of conveyance, and (3) a saddle stitching mode in which the stitching operation is performed at least at one position at halfway point across the length of the sheet in the sheet conveyance direction, the stitched sheet stack is folded at the folded position into a booklet, and the booklet is collected on the folded sheet stack discharge stacker 80.

As listed in Table 1 below, the side stapling modes include (a) a standard mode in which the stack of the sheets is stitched at the forward edge thereof with staples with the edges of all the sheets forming the stack aligned (see FIG. 14(A)), (b) an insert mode in which the unstitched sheets are inserted with the edges thereof aligned between the stitched sheets (see FIG. 14(B)), and (c) an offset insert mode in which the sheets not to be stitched are inserted with the edges thereof shifted by an offset a between the stitched sheets (see FIG. 14(C)). Typically, a distance b from the forward edge of the sheet to be stitched to the staple is 5 to 7 mm. The offset a is set to be longer than the distance b (offset a>distance b) so that the sheets not to be stitched are prevented from being accidentally stitched. In this embodiment, the offset a may be set to be larger than 1 cm taking into consideration of errors in each elements of the apparatus.

TABLE 1

| Mode | Detailed mode | Setting information |
|---|---|---|
| Non-stapling | — | — |
| Side stapling | Standard | — |
| | Insert | Insert page, stack destination |
| | Offset insert | Insert page, stack destination, offset |
| Saddle stitching | — | — |

An operation of the digital copying apparatus main unit 1 is explained below.

The CPU of the controller 950 allows the touch panel 248 to display a default screen through the display and operation controller 250. At this moment, in addition to the sheet size selection switch button, mode selection switch button, and stack destination selection switch button shown in FIG. 2, the touch panel 248 (or a monitor of the personal computer 210) displays a clear button for clearing the selected mode; an image reading button for reading an image from the original document D; a print mode selection switch button for switching between a both-side printing mode for printing images on both sides of the sheet and a one-side printing mode for printing images on one side of the sheet; a start button for starting the digital copying apparatus main unit 1 to form an image in the selected mode; a standby status or image forming enabled status of the digital copying apparatus 1A, and the number of the images formed sheets. It is possible to input all or a part of these selections and settings through the personal computer 210 or a manual switch such as the stapler selection switch 935 represented by a filled circuit shown in FIG. 1.

As shown in Table 1, when the side stapling mode is selected, the touch panel 248 displays a next screen for selecting one of the standard mode, insert mode and offset insert mode. When one of the modes is selected, the touch panel 248 prompts to input setting information such as an insert page, stack destination, and offset. The user may enter the setting information using numeric keys. The insert page refers to a page into which the unstitched sheets are inserted as shown in FIGS. 14(B) and 14(C).

When a plurality of the unstitched sheets is inserted, a plurality of the pages may be entered. The offset refers to the offset a shown in FIGS. 14(B) and 14(C). The default value of the offset a is 1 cm. To set an offset larger than 1 cm, the user may modify the offset using the numeric keys. The stack destination refers to one of the lifting tray 90 and box-like stack container 88 shown in FIG. 3.

When the image reading button on the touch panel 248 is pressed and the original document D is set on the automatic document feeder 940, the CPU of the controller 950 captures the image data read by the image input unit 200 through the A/D converter 960, and stores the image data onto the hard disk 961. When the image reading is completed, the CPU of the controller 950 sends an inquiry as to whether to attach a name to a folder of (a plurality of) the image data stored in the hard disk 961 using the touch panel 248. If it is the case, a character string (input using the numeric keys or the like) is set as the name of the folder. If it is not the case, a tentative name is attached to the folder on the assumption that the folder is used only for the current job. The image of the folder with the tentative name attached thereto will be deleted at the end of the current job. When the image data is transmitted from the personal computer 210, it is requested to attach a name to the folder storing the image data. In the same manner as when the image data is read from the automatic document feeder 940, the name is attached to the folder.

When the image is scanned and read using the automatic document feeder 940, it is possible to determine that the reading of the original document D is completed based on the signal of an empty sensor (not shown) in the automatic document feeder 940. When the original document D is read page by page without using the automatic document feeder 940, the controller 950 requests the user to press the image reading end button. When the button is pressed, the controller 950 determines that the reading is completed.

As shown in Table 1, when the information according to the selected detailed mode is entered, the CPU of the controller 950 sends the mode and the setting information to the controller 149 of the sheet post-processing device 2, and allows the image forming assembly 902 to form the images in accordance with the image data stored in the folder in the hard disk 961 according to the name of the designated folder.

When a sheet feed signal is output from the controller 950, the sheet is supplied from one of the cassettes 910, 911, and 913 in accordance with the input sheet size. A pair of timing rollers in the sheet feeder 909 corrects skew of the sheet, and is then fed to the image forming assembly 902 after the timing is adjusted. The CPU of the controller 950 allows the laser unit 922 to direct a laser beam to the photoconductive drum 914 one line at a time in accordance with the image per one document sheet.

The primary charging unit 919 charges the photoconductive drum 914 in advance, and the laser beam forms an electrostatic latent image on the photoconductive drum 914. The electrostatic latent image is developed into a toner image on the photoconductive drum 914 by the development unit 915.

In the image forming assembly 902, the toner image on the photoconductive drum 914 is transferred to the supplied sheet by the transfer unit 916. The sheet having the toner image is charged by the separating charging unit 917 into a polarity opposite to that of the transfer unit 916, and is then separated from the photoconductive drum 914. The sheet separated from the photoconductive drum 914 is conveyed to the fixing unit 904 by the endless conveyance belt 920. The transferred image is thus permanently fixed onto the sheet by the fixing unit 904. The image is thus formed (recorded) on the sheet.

In the both-side printing mode, the image is formed on the other side of the sheet using the duplexer 921. The discharge roller pair 905 discharges the sheet having the image into the sheet post-processing device 2 from the digital copying apparatus main unit 1. In this way, the images are formed on the sheets fed from the sheet feeder 909, and the sheets having the image are successively discharged into the sheet post-processing device 2.

An operation of the sheet post-processing device 2 will be explained for each operational mode. When the non-stapling mode is selected, the controller 149 activates the stepping motor 70, thereby moving the pushing claw 13 from the HP position shown in FIG. 6 to a pre-home position (hereinafter referred to as PreHP position) to function as a sheet collection reference on the process tray 8. The conveyance upper roller 19 then stays at the spaced position, and the stopper 21 stays at the retraction position. As shown in FIG. 6, the PreHP position is spaced apart from the HP position of the pushing claw 13 by a distance (L2+$\alpha$), and is closer to the lifting tray 90 by $\alpha$ distance a than the contact point Q between the conveyance lower roller 18 and conveyance upper roller 19. The movement by the distance (L2+$\alpha$) is detected by counting the number of steps of the stepping motor 70.

Concurrently, the controller 149 activates the conveyance motor 162, thereby rotating the driving rollers of the conveyance roller pair 5 and discharge roller pair 6 until the sheet is discharged from the discharge roller pair 905 in the digital copying apparatus main unit 1. When the sheet is discharged from the digital copying apparatus main unit 1, the conveyance roller pair 5 and discharge roller pair 6 convey the sheet to the process tray 8. When the sheet detector sensor 4 detects the sheet, the controller 149 measures start timings of the alignment motor 14 for moving the alignment plates 9 and paddle motor 165 for rotating the paddle 17. The controller 149 receives information about the size of the sheet and the direction of the sheet with respect to the conveyance direction from the controller 950 of the digital copying apparatus main unit 1 beforehand, and stores the information in the RAM.

When the sheet is discharged into the process tray 8, the alignment motor 14 and paddle motor 165 are activated. In response, the alignment plates 9 move in the width direction perpendicular to the sheet conveyance direction to align both edges of the sheet. The paddle 17 rotates so that the edge of the sheet is aligned against the end face of the pushing claw 13 already situated at the PreHP position. These steps of the operation are repeated each time when each sheet is discharged into the process tray 8.

When a predetermined number of the sheets are aligned against the end face of the pushing claw 13, the conveyance motor 162 and paddle motor 165 are stopped. The stepping motor 70 is activated to move the conveyance belt 12, so that the end face of the pushing claw 13 pushes the sheets toward the lifting tray 90 (in the arrow direction A in FIGS. 3 and 6). The sheet stacks are collected on the lifting tray 90. Since the distance L1 is smaller than the distance L2 as shown in FIG. 6, the end face of the pushing claw 13 in a vertical state pushes the edge of the sheet stack toward the lifting tray 90, thereby eliminating extra stress in the sheet stack during the movement.

When the sheet stack is placed on the lifting tray 90, the controller 149 allows the lifting tray motor 155 to rotate, thereby lowering the lifting tray 90 by a certain distance. The controller 149 then allows the lifting tray motor 155 to rotate in a reverse direction, thereby raising the lifting tray 90 to a position where the sheet surface sensor 93 detects the surface of the top sheet of the stack. The lifting tray 90 remains at this position until the next sheet stack is placed.

In the non-stapling mode requiring no stitching process, the sheet stack aligned at the PreHP position of the pushing claw 13 is pushed toward the lifting tray 90 without conveying the sheets to the restraining position of the stopper 21. Therefore, even if the digital copying apparatus main unit 1 discharges the sheets at a high discharge rate, the sheet post-processing device 2 keeps pace with the discharge rate.

When the PreHP position of the pushing claw 13 overlaps the conveyance path guide 7 above an upper edge of the pushing claw 13, it is possible to reliably stack the sheets successively brought in one by one along the end face of the pushing claw 13.

When the standard mode of the side stapling is selected, the controller 149 activates the stapler slide motor 42 to move the head assembly 31 and anvil assembly 32 to the initial position to be detected by the staple slide HP sensor 168. The controller 149 turns on the solenoid 22, thereby placing the stopper 21 at the restraining position.

The controller 149 activates the conveyance motor 162, thereby rotating the conveyance roller pair 5 and discharge roller pair 6 to discharge the sheet into the process tray 8 from the digital copying apparatus main unit 1. The alignment motor 14 and paddle motor 165 are then activated. The alignment plates 9 align both sides of the sheet in the width direction, and then the sheet is stopped when the edge of the sheet abuts against the sidewall of the leg of the stopper 21. This step is repeated by a predetermined number of times so that the stopper 21 restrains the sheet stack.

In the state that the sheet stack is restrained by the stopper 21, the conveyance upper roller 19 is shifted toward the conveyance lower roller 18 to nip the sheet stack. The solenoid 22 is turned off to move the stopper 21 to the retraction position thereof. The stepping motor 70 rotates by a predetermined number of steps in a direction opposite to the direction thereof in the non-stapling mode.

In response to the rotation, the conveyance upper roller 19 and conveyance lower roller 18 with the sheet stack nipped therebetween convey the sheet stack in the arrow direction B in FIG. 3 toward the stapler unit 30 until the stitching position of the sheet stack reaches a head position of the head assembly 31 at an initial position.

The one-way clutch 75 (see FIG. 4) is interposed between the first pulley shaft 10*a* and first pulley 10 where the conveyance belt 12 is placed. When the stepping motor 70 rotates in the reverse direction in this way, the rotation of the stepping motor 70 is not transferred to the conveyance belt 12, and the conveyance belt 12 and pushing claw 13 remain stationary due to the one-way clutch 75.

The controller 149 activates the stapling/folding motor 170, thereby allowing the head assembly 31 and anvil assembly 32 to perform the stitching operation on the edge portion of the sheet stack. When the stitching operation is performed at a plurality of positions, the controller 149 activates the stapler slide motor 42 to move the stapler unit 30 and then the stitching operation is performed.

When the stitching operation is completed, the sheet stack is conveyed to the stack destination (one of the lifting tray 90 and box-like stack container 88) selected through the stack destination switch. When the sheet stack is conveyed to the lifting tray 90, the stepping motor 70 drives the conveyance lower roller 18, conveyance upper roller 19, and conveyance belt 12 toward the lifting tray 90. Subsequent to the stitching operation, the sheet stack is handed over to the pushing claw 13 from the conveyance lower roller 18 and conveyance upper roller 19.

The pushing claw 13 pushes and places the sheet stack on the lifting tray 90. The remaining operation of the side stapling mode is the same as that of the non-stapling mode, and the further explanation thereof is omitted. The operation of the conveyance of the sheet stack to the box-like stack container 88 is identical to that of the insert mode to be explained next.

When the side stapling insert mode is selected, the controller 149 activates the stapler slide motor 42 to move the head assembly 31 and anvil assembly 32 to the initial position to be detected by the staple slide HP sensor 168. The controller 149 turns on the solenoid 22, thereby placing the stopper 21 at the restraining position. The conveyance upper roller 19 is situated at the spaced position.

The controller 149 activates the conveyance motor 162, thereby rotating the conveyance roller pair 5 and discharge roller pair 6, and then waits in the standby state until the discharge roller pair 905 of the digital copying apparatus main unit 1 discharges the sheet. When the sheet is discharged from the digital copying apparatus main unit 1, the conveyance roller pair 5 and discharge roller pair 6 convey the sheet to the process tray 8. When the sheet detector sensor 4 detects the first sheet, the controller 149 measures start timings of the alignment motor 14 for moving the alignment plates 9 and paddle motor 165 for rotating the paddle 17. Depending on the sheet size, the controller 149 drives the stepping motors 306 and 316 to place the sheet pressing levers 300 and 310 at positions appropriate for the sheet size. The solenoids 301 and 311 remain off.

Figure 14:
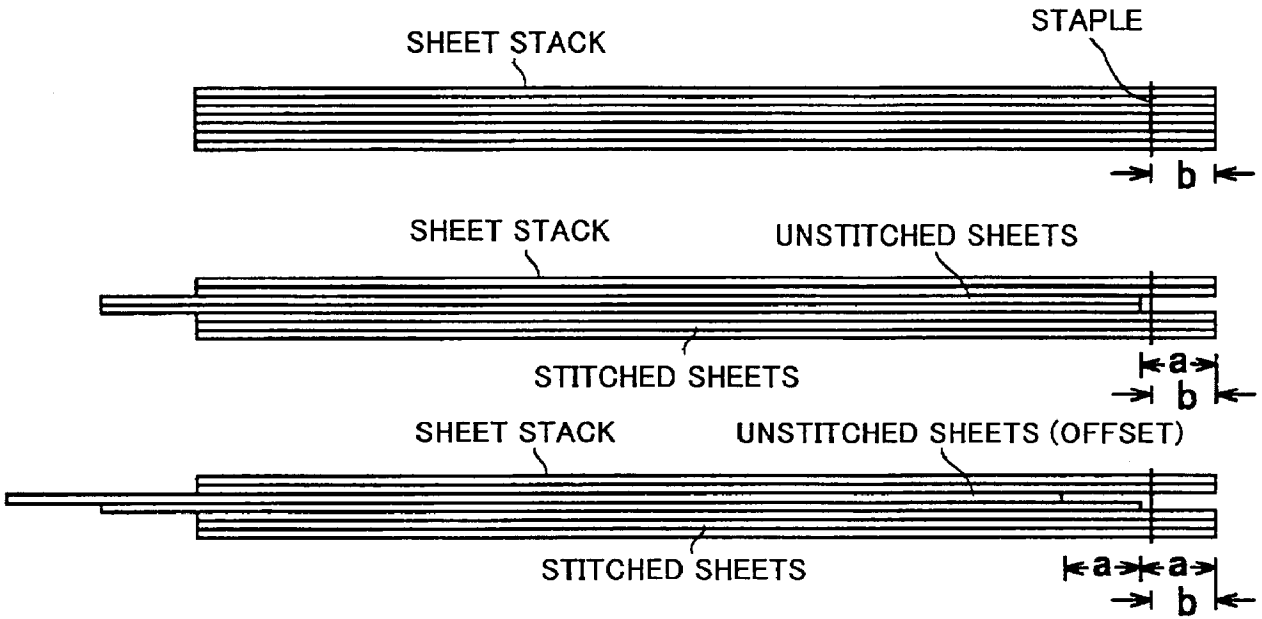
Figure 15A:
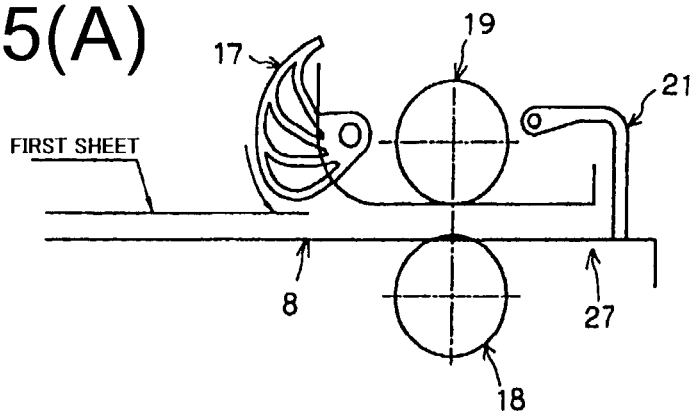

As shown in FIG. 15(A), when the first sheet is discharged to the process tray 8, the alignment motor 14 and paddle motor 165 are activated. In response, the alignment plates 9 move in the width direction perpendicular to the sheet conveyance direction, and align both edges of the sheet. The paddle 17 rotates around the axis 17*a* thereof by one revolution to move the first sheet with the tilted surface of the process tray 8 and first stack guide 27 until the forward edge of the first sheet abuts against the sidewall of the leg of the stopper 21 at the restraining position. Similarly, an n number of the sheets to be stitched are conveyed to a position where the forward edges of the sheets abut against the sidewall of the leg of the stopper 21 at the restraining position. In this way, the forward edges of the sheets to be stitched (the n number of the sheets) and situated below the sheet not to be stitched are aligned on the process tray 8 as shown in FIG. 14(B).

Figure 15B:
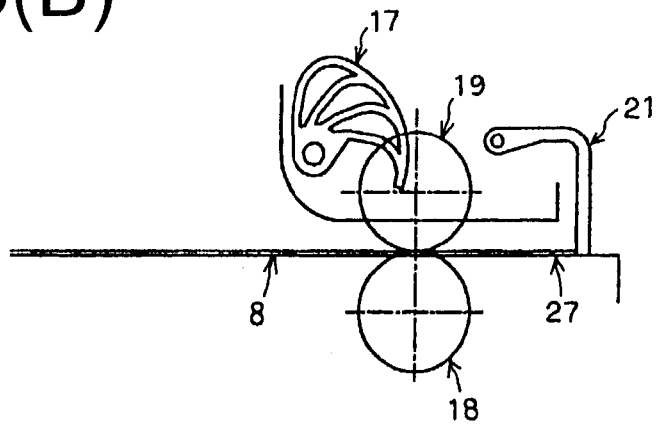
Figure 15C:
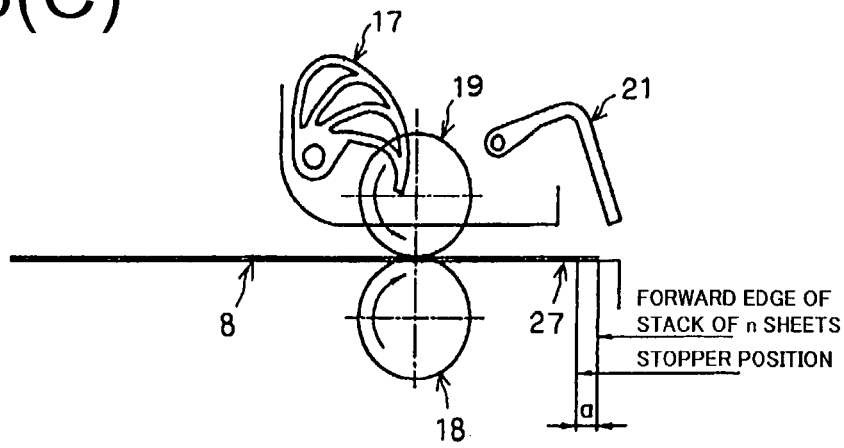

The conveyance upper roller 19 is shifted from the spaced position to the contact position to nip the n number of the sheets with the conveyance lower roller 18 (see FIG. 15(B)). The stopper 21 is then moved to the retraction position. With the stepping motor 70 rotating, the n number of the sheets nipped between the conveyance lower roller 18 and conveyance upper roller 19 are moved toward the stapler unit 30 by an offset of a from the sidewall of the stopper 21 abutting against the forward edges. Then, the stepping motor 70 stops rotating the conveyance lower roller 18 and conveyance upper roller 19 (see FIG. 15(C)).

Figure 16A:
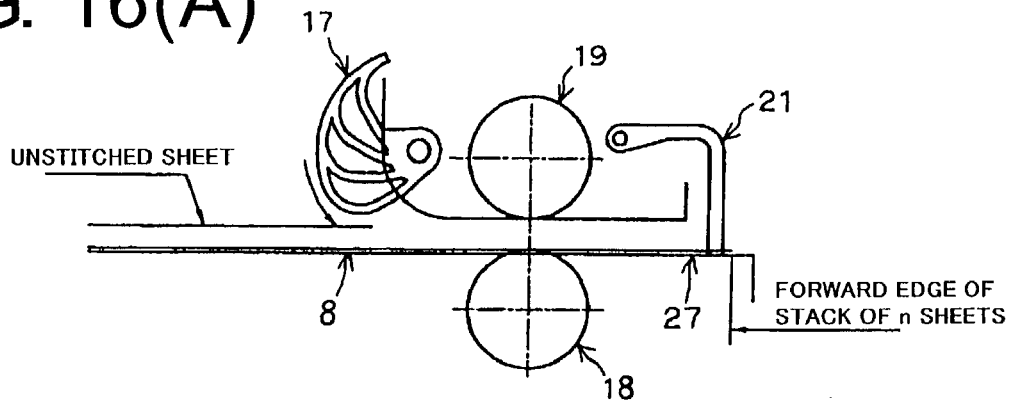

When the solenoid 22 is turned on, the conveyance upper roller 19 is then moved to the spaced position from the contact position thereof with the bottom face of the leg of the stopper 21 pressing the forward edge of the n number of the sheets against the first stack guide 27 serving as a receiver for the n number of the sheets. When the first sheet not to be stitched is discharged into the process tray 8, the paddle motor 165 starts rotating (see FIG. 16(A)). Similarly, a plurality of the sheets not to be stitched is moved until the forward edges thereof abut against the sidewall of the leg of the stopper 21 at the restraining position.

Figure 16B:
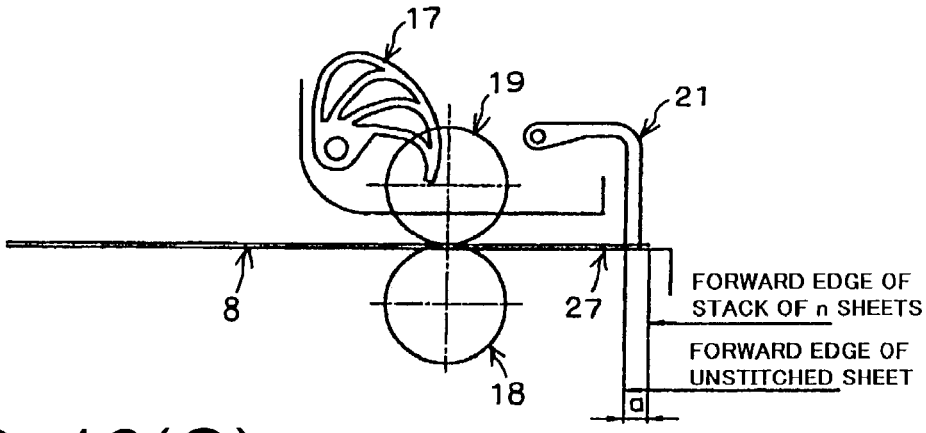

At this moment, the forward edges of the n number of the sheets to be stitched are shifted from the forward edges of the plurality of the sheets not to be stitched by the offset a on the process tray 8 (see FIG. 14(B)). The conveyance upper roller 19 moves from the spaced position to the contact position to nip the n number of the sheets to be stitched and the plurality of the sheets not to be stitched with the conveyance lower roller 18 (see FIG. 16(B))

Figure 16C:
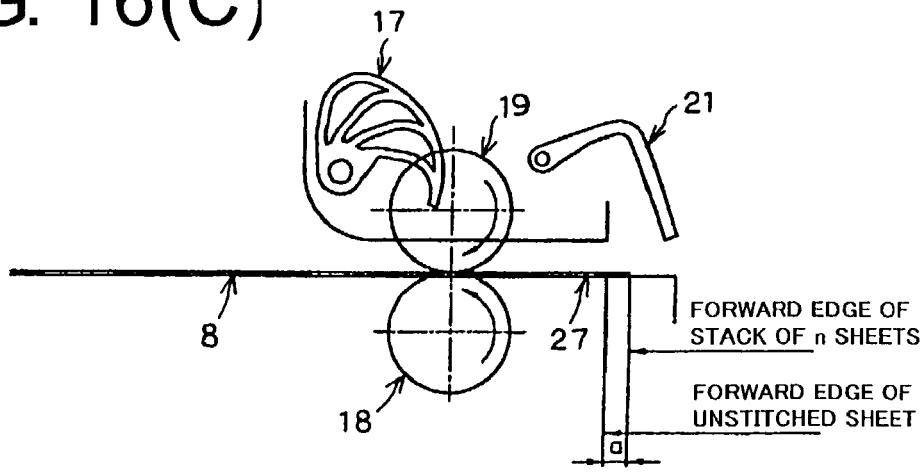

Then, the stopper 21 is moved to the retraction position. The n number of the sheets to be stitched and the plurality of the sheets not to be stitched nipped between the conveyance lower roller 18 and conveyance upper roller 19 are moved toward the lifting tray 90 by the offset a from the sidewall of the stopper 21 abutting against the forward edges of the sheets not to be stitched. Then, the stepping motor 70 stops rotating the conveyance lower roller 18 and conveyance upper roller 19 (see FIG. 16(C)).

Figure 17A:
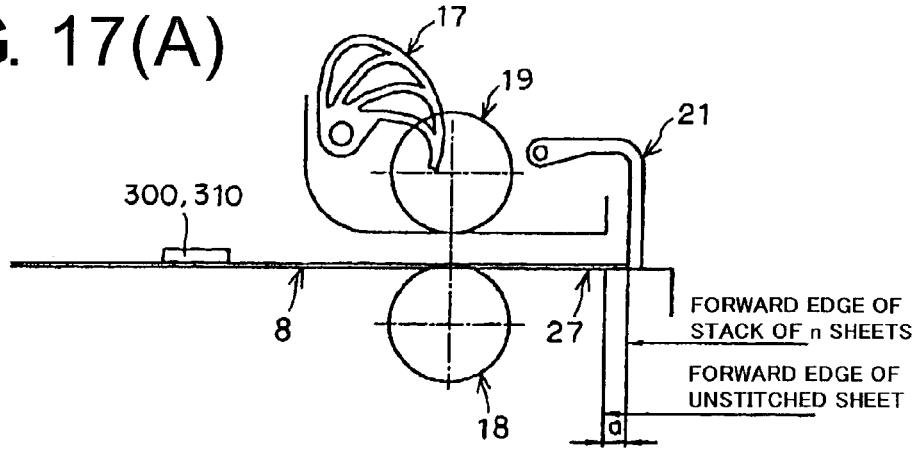

Then, the solenoids 301 and 311 are turned on, thereby allowing the sheet pressing levers 300 and 311 to press the n number of the sheets to be stitched and the plurality of the sheets not to be stitched. When the solenoid 22 is turned on, the n number of the sheets to be stitched are aligned against the sidewall of the leg of the stopper 21, and the conveyance upper roller 19 moves from the contact position to the spaced position (FIG. 17(A)).

Figure 17B:
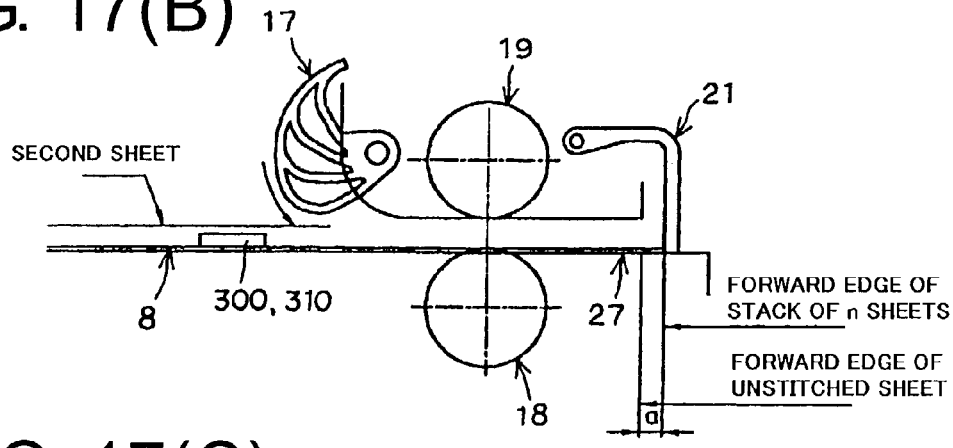

When the next sheet is discharged into the process tray 8, the paddle motor 165 starts rotating (see FIG. 17(B)). With the paddle 17 rotating, the sheet to be stitched is conveyed to the position where the forward edge thereof abuts against the sidewall of the leg of the stopper 21 at the restraining position. This process is repeated until the forward edge of an m-th sheet (i.e., the last sheet of the sheet stack) abuts against the sidewall of the leg of the stopper 21.

As shown in FIG. 14(B), the n number of the sheets to be stitched and the m number of the sheets to be stitched are aligned on the process tray 8 with the offset a between the forward edges of the n plus m number of the sheets to be stitched and the forward edges of the sheets not to be stitched.

The solenoids 301 and 311 are then turned off, thereby allowing the sheet pressing levers 300 and 310 to release the n plus m number of the sheets to be stitched and the plurality of the sheets not to be stitched. The conveyance upper roller 19 then moves from the spaced position to the contact position. The solenoid 22 is turned off with all the sheets nipped between the conveyance lower roller 18 and conveyance upper roller 19, thereby shifting the stopper 21 to the retraction position thereof.

Figure 17C:
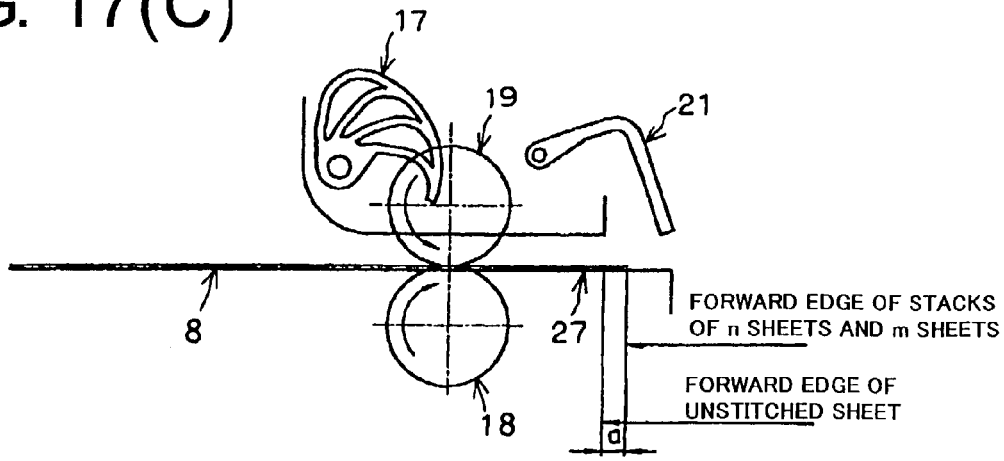

With the stepping motor 70 rotating, the sheet stack nipped between the conveyance upper roller 19 and conveyance lower roller 18 is conveyed to the stapler unit 30 (see FIG. 17(C)). In response, the conveyance upper roller 19 and conveyance lower roller 18 convey the sheet stack with the offset a maintained until the position at the distance b from the forward edge of the sheets to be stitched reaches the head position of the head assembly 31 (see FIG. 14(B)). The conveyance of the sheet stack then stops.

The stapling/folding motor 170 drives the head driving shaft 38 and anvil driving shaft 37 in the operational directions thereof to perform the stitching operation. When the stitching operation is performed at a plurality of the stitching positions, the stapler slide motor 42 is activated. With the guide screw shafts 35 and 36 rotating, the head assembly 31 and anvil assembly 32 are moved to a predetermined position in a direction perpendicular to the sheet conveyance direction, and then the stitching operation is performed.

When the stitching operation is completed, the sheet stack is conveyed to the stack destination (one of the lifting tray 90 and box-like stack container 88) selected through the stack destination switch. When the sheet stack is conveyed to the lifting tray 90, the stepping motor 70 conveys the sheet stack nipped between the conveyance lower roller 18 and conveyance upper roller 19 to the process tray 8. As in the standard mode, the stepping motor 70 drives the conveyance lower roller 18, conveyance upper roller 19, and conveyance belt 12, thereby allowing the pushing claw 13 to push the sheet stack toward the lifting tray 90. The sheet stack is thus placed on the lifting tray 90.

When the sheet stack is placed on the box-like stack container 88 on the other hand, the stepping motor 70 is operated to convey the sheet stack nipped between the conveyance upper roller 19 and conveyance lower roller 18 toward the folding unit 50. The conveyance roller 162 is rotated in a reverse direction to rotate the upper roller movement cam 68. The stack conveyance upper roller 51 is then lowered toward the stack conveyance lower roller 52 through the bearing holder 102. The sheet stack is thus nipped by the pulling spring 104. The conveyance roller 162 is then rotated in a forward direction to rotate the stack conveyance upper roller 51 and stack conveyance lower roller 52.

Figure 22:
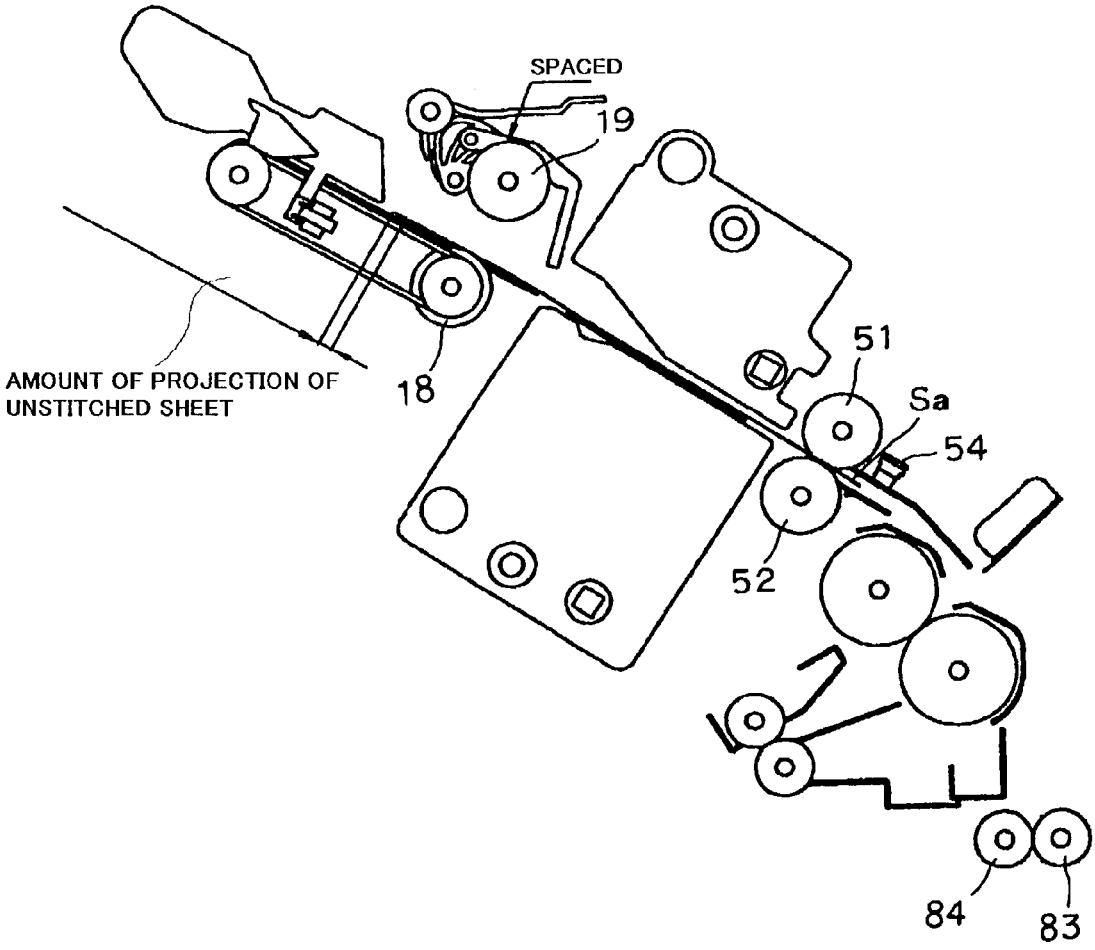
FIG. 22 is the second diagram explaining a conveyance operation of a sheet stack around the offset unit, stapler unit, and folding unit in the insert mode and offset insert mode.

As shown in FIG. 22, when the edge detector sensor 54 detects the forward edge of the sheet stack Sa, the CPU of the controller 149 moves the conveyance upper roller 19 away from the conveyance lower roller 18 and stops the stepping motor 70. The CPU of the controller 149 moves the driving roller 84 from the spaced position to the contact position where the driving roller 84 is pressed against the driven roller 83 through a cam mechanism (not shown) to drive the driving roller 84. The sheet stack Sa is conveyed into the box-like stack container 88 in the sheet stack passage 58 by the stack conveyance upper roller 51 and stack conveyance lower roller 52.

Figure 23:
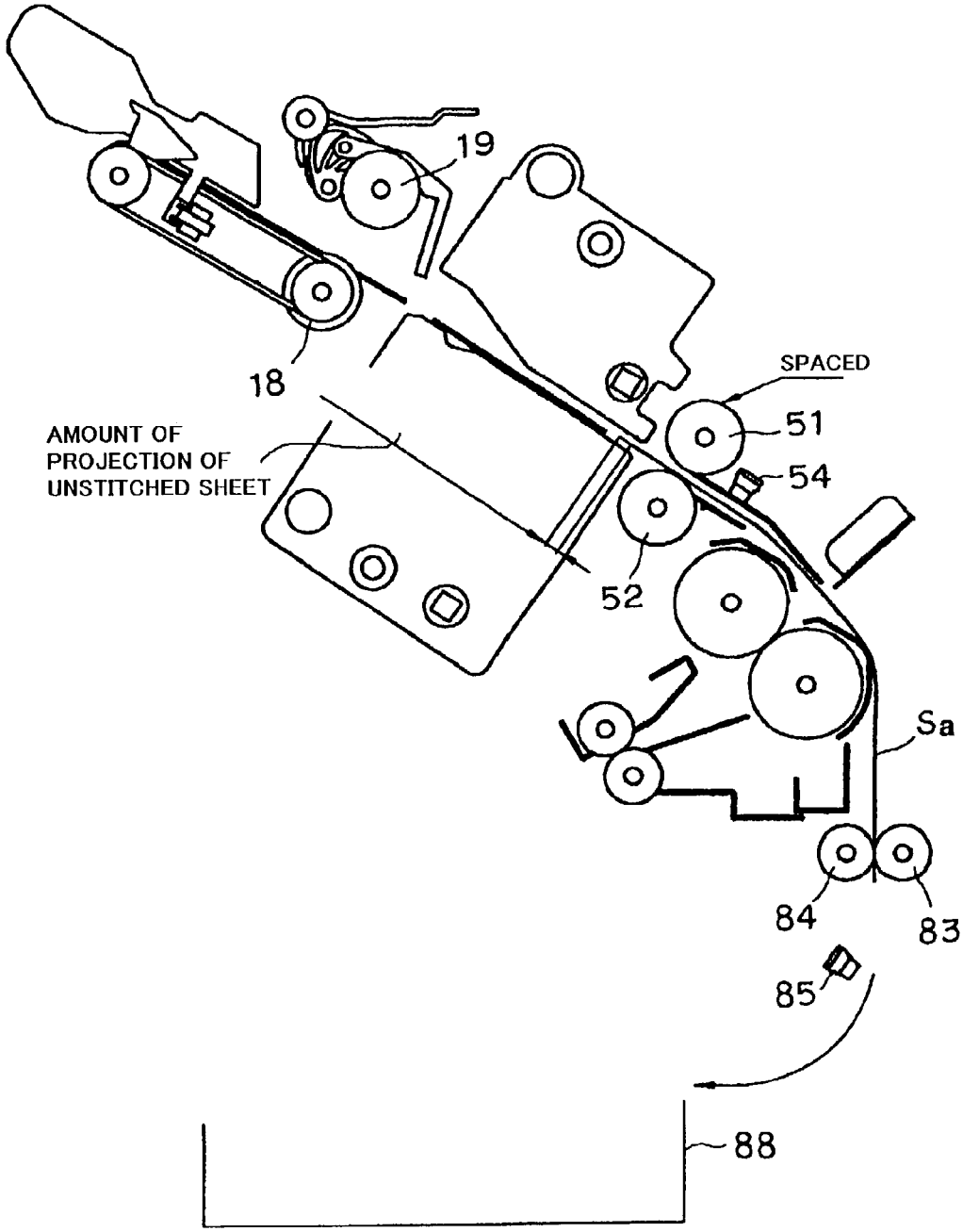
FIG. 23 is the third diagram explaining a conveyance operation of a sheet stack around the offset unit, stapler unit, and folding unit in the insert mode and offset insert mode.

As shown in FIG. 23, when the edge detector sensor 85 detects the forward edge of the sheet stack Sa, the CPU of the controller 149 moves the stack conveyance upper roller 51 away from the stack conveyance lower roller 52, and stops the conveyance roller 162. The sheet stack Sa is conveyed into the box-like stack container 88 through the sheet stack passage 58 by the driving roller 84 and driven roller 83. When the sheet stack Sa is conveyed by a predetermined distance from the forward edge thereof (before the driving roller 84 and driven roller 83 nip the rear edge of the sheets not to be stitched in the sheet stack Sa), the driving roller 84 moves away from the driven roller 83. The driving roller 84 then stops rotating.

As shown in FIG. 3, the sheet stack passage 58 has a tilted portion toward the box-like stack container 88 below the edge detector sensor 85. Therefore, even without drive of the driving roller 84, the sheet stack Sa drops down toward the box-like stack container 88 by its own weight. In this way, the sheet stack Sa is collected in the box-like stack container 88.

When the sheet stack Sa is conveyed to the box-like stack container 88, the sheet stack Sa is successively moved along one roller or both rollers of each of the pairs of the conveyance upper roller 19, and conveyance lower roller 18, stack conveyance upper roller 51 and stack conveyance lower roller 52, and driving roller 84 and driven roller 83. The forward edge of the sheet stack Sa is detected by each of the edge detector sensors 54 and 85. The conveyance upper roller 19, stack conveyance upper roller 51, and driving roller 84 move successively away from the conveyance lower roller 18, stack conveyance lower roller 52, and driven roller 83, respectively so that the rear edges of the sheets not to be stitched and inserted into the sheet stack Sa do not contact these rollers.

When the side stapling offset insert mode is selected, the controller 149 performs almost the same process as the insert mode. As shown in FIGS. 14(B) and 14(C), the difference between the insert mode and the offset insert mode is whether the sheets not to be stitched are shifted or aligned. An explanation of the same process as the insert mode is omitted, and only the difference therebetween is explained below. In the offset insert mode, the process shown in FIGS. 18(A)–18(C) and FIGS. 19(A)–19(C) is carried out instead of the process shown in FIGS. 16(A)–16(C) in the insert mode.

Figure 18A:
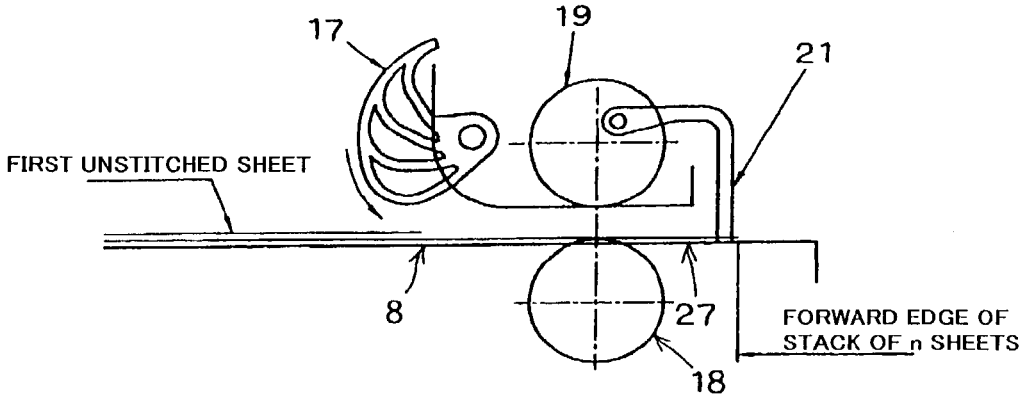
Figure 18B:
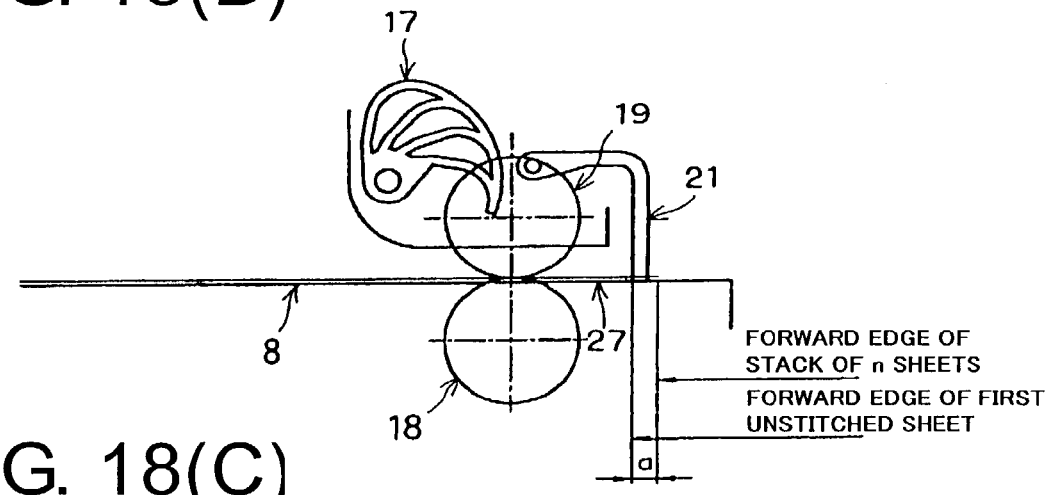
Figure 18C:
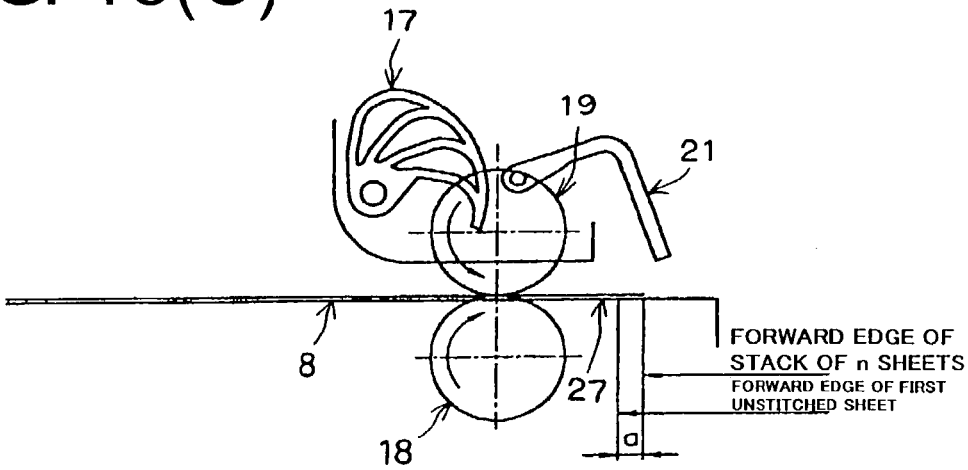
Figure 19A:
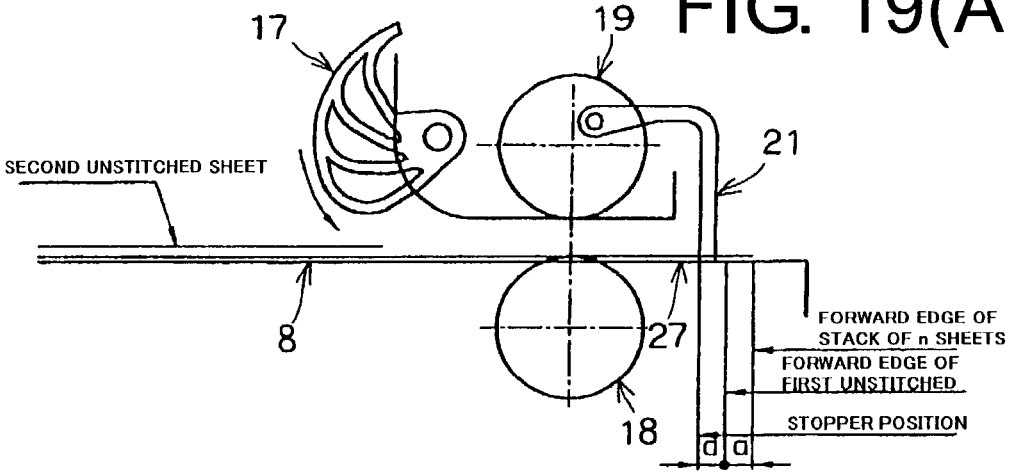
Figure 19B:
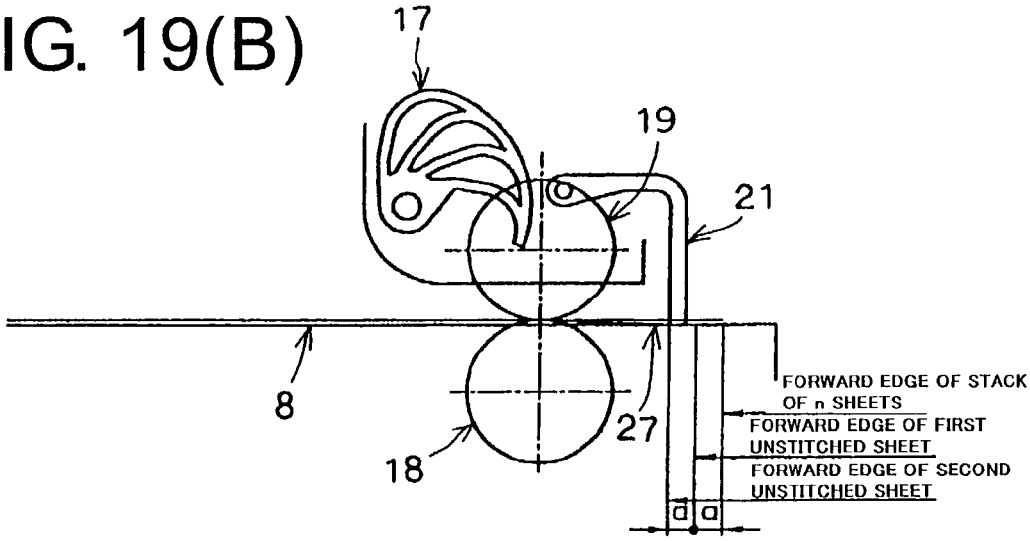
Figure 19C:
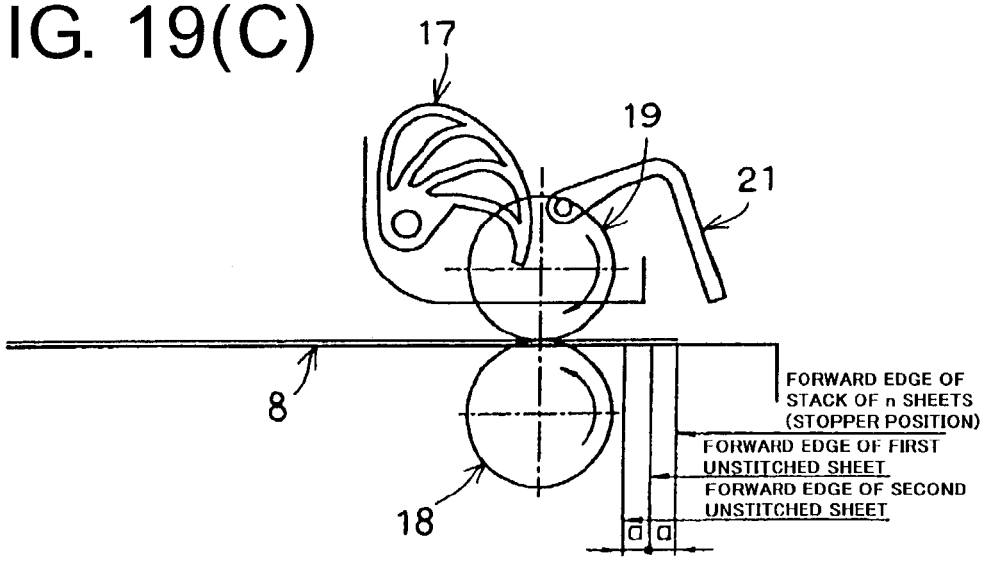

After the bottom face of the leg of the stopper 21 presses the forward edge of the stack of the n number of the sheets from above against the first stack guide 27 serving as a receiver, the conveyance upper roller 19 moves from the contact position to the spaced position. The paddle 17 rotates around the axis 17*a* (as shown in FIG. 18(A)) to convey the first sheet not to be stitched with the forward edge thereof abutting the sidewall of the leg of the stopper 21 at the restraining position thereof in cooperation with the inclined surface of the process tray 8 and first stack guide 27. All the sheets (the n number of the sheets to be stitched and the first sheet not to be stitched) are nipped between the conveyance lower roller 18 and conveyance upper roller 19 on the process tray 8 (as shown in FIG. 18(B)).

The stopper 21 is then shifted to the retraction position. With the stepping motor 70 rotating, all the sheets nipped between the conveyance lower roller 18 and conveyance upper roller 19 are moved by the offset a toward the stapler unit 30 from the sidewall of the leg of the stopper 21 abutting the forward edge of the first sheet not to be stitched. The stepping motor 70 then stops rotating the conveyance lower roller 18 and conveyance upper roller 19 (see FIG. 18(C)).

The bottom face of the leg of the stopper 21 presses the forward edges of all the sheets against the first stack guide 27 serving as a receiver with the solenoid 22 turned on, and the conveyance upper roller 19 moves from the contact position to the spaced position. In this state, there is the offset a between the forward edge of the stack of the n number of the sheets to be stitched and the forward edge of the first sheet not to be stitched, and between the forward edge of the first sheet not to be stitched and the sidewall of the leg of the stopper 21. When the second sheet S is discharged into the process tray 8, the paddle motor 165 starts rotating (see FIG. 19(A)).

The paddle 17 rotates by one revolution to move the second sheet not to be stitched until the forward edge of the second sheet abuts against the sidewall of the leg of the stopper 21 at the restraining position. There is the offset a between the first sheet not to be stitched and the second sheet not to be stitched. The conveyance upper roller 19 is then shifted from the spaced position to the contact position to nip all the sheets (the n number of the sheets to be stitched and first and second sheets S not to be stitched) against the conveyance lower roller 18 (see FIG. 19(B)) on the process tray 8. Likewise, the shifting operation of the sheets not to be stitched is repeated in accordance with the number of insert pages p input through the touch panel 248 and stored in the RAM of the controller 950.

Then, the stopper 21 is shifted to the retraction position. All the sheets nipped between the conveyance lower roller 18 and conveyance upper roller 19 on the process tray 8 are moved toward the lifting tray 90 by a distance equal to a product of the offset a by the number of the insert pages p. The rotation of the conveyance lower roller 18 and conveyance upper roller 19 then stops (see FIG. 19(C)). In this state, the offset a is allowed between the forward edge of the stack of the n number of the sheets to be stitched and the forward edge of the first sheet not to be stitched, and between the forward edge of the first sheet not to be stitched and the forward edge of the second sheet not to be stitched (the same is true up to the p-th sheet not to be stitched) as shown in FIG. 14(C).

Figure 20:
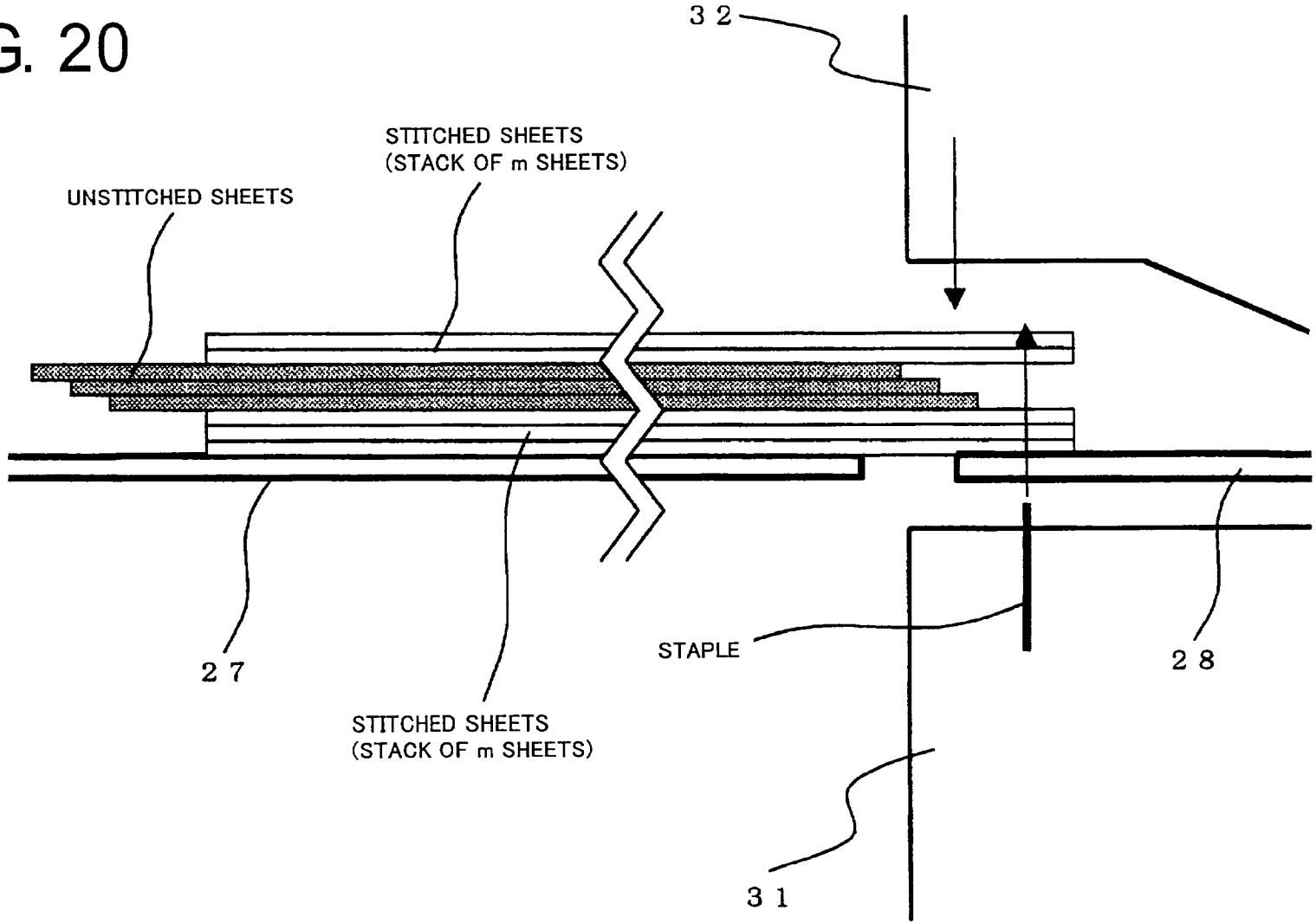
FIG. 20 is a view illustrating a stitching position of the stapler unit in the offset insert mode.

As in the insert mode, the side stitching process is performed on the stack sheet, and then, the stack sheet is conveyed to one of the lifting tray 90 and box-like stack container 88. As shown in FIG. 20, in the offset insert mode, the stitching process is performed so that the staple does not stitch the first sheet not to be stitched.

The sheet stack Sa is conveyed to the box-like stack container 88. The projection of the sheets not to be stitched becomes large. Depending on the product of the offset a and the number of the insert pages (or the result of reference to the table), the conveyance upper roller 19, stack conveyance upper roller 51, and driving roller 84 move successively away from the conveyance lower roller 18, stack conveyance lower roller 52, and driven roller 83, respectively so that the rear edges of the sheets not to be stitched inserted into the sheet stack Sa do not contact these rollers.

When the saddle stitching mode is selected, the sheet discharged from the digital copying apparatus main unit 1 is placed on the process tray 8 as in the side stapling standard mode. After being aligned and placed on the process tray 8, the conveyance upper roller 19 is lowered to nip the sheet stack with the conveyance lower roller 18. The solenoid 22 is turned off to move the stopper 21 to the retraction position.

The stepping motor 70 is rotated in a direction opposite to that in the non-stapling mode. The sheet stack nipped between the conveyance upper roller 19 and conveyance lower roller 18 is conveyed toward the stapler unit 30. In this state, the head assembly 31 and anvil assembly 32 remain stationary at the initial positions thereof in a direction perpendicular to the sheet conveyance direction.

When the edge detector sensor 54 detects the forward edge of the sheet stack after the sheet stack is conveyed, the controller 149 conveys the sheet stack in accordance with information about the length of the sheet in the sheet conveyance direction received from the digital copying apparatus main unit 1 and stored in the RAM, until the center of the sheet in the sheet conveyance direction reaches a stitching position. The stepping motor 70 then stops.

The stapling/folding motor 170 drives the head driving shaft 38 and anvil driving shaft 37 in the operational directions thereof to perform the stitching operation. When the stitching operation is performed at a plurality of the stitching positions, the stapler slide motor 42 is activated. With the guide screw shafts 35 and 36 rotating, the head assembly 31 and anvil assembly 32 are moved to a predetermined position in a direction perpendicular to the sheet conveyance direction, and then a stitching operation is performed. When the sheet stack is conveyed to the stitching position, the forward edge of the sheet stack has already passed the stack conveyance upper roller 51 in the folding unit 50 at the spaced position away from the stack conveyance lower roller 52.

To perform the folding operation, the conveyance motor 162 is rotated in a reverse direction to rotate the upper roller movement cam 68 (see FIG. 9). The stack conveyance upper roller 51 is then lowered toward the stack conveyance lower roller 52 through the bearing holder 102. The sheet stack is thus nipped by means of the pulling spring 104. The conveyance upper roller 19 is moved to the spaced position to release the sheet stack.

Figure 24A:
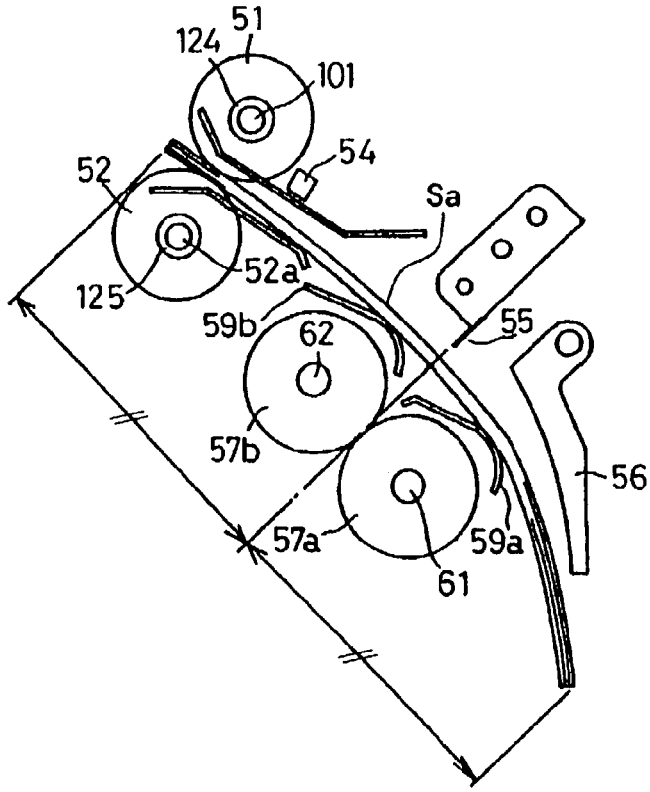

Then, the conveyance motor 162 is activated to rotate the stack conveyance upper roller 51 and stack conveyance lower roller 52 to convey the sheet stack further in a downstream direction. During the conveyance, the controller 149 slows and then stops the conveyance motor 162 in accordance with a signal detected by the edge detector sensor 54 and sheet length information stored in the RAM so that a center point of the sheet in the sheet conveyance direction, i.e., the stitching point, is situated at the folding position. In this state, the forward edge of the sheet stack is suspended in the sheet stack passage 58 with the stack nipped between the stack conveyance upper roller 51 and stack conveyance lower roller 52 (see FIG. 3 and FIGS. 24(A) and 24(B)).

Figure 24B:
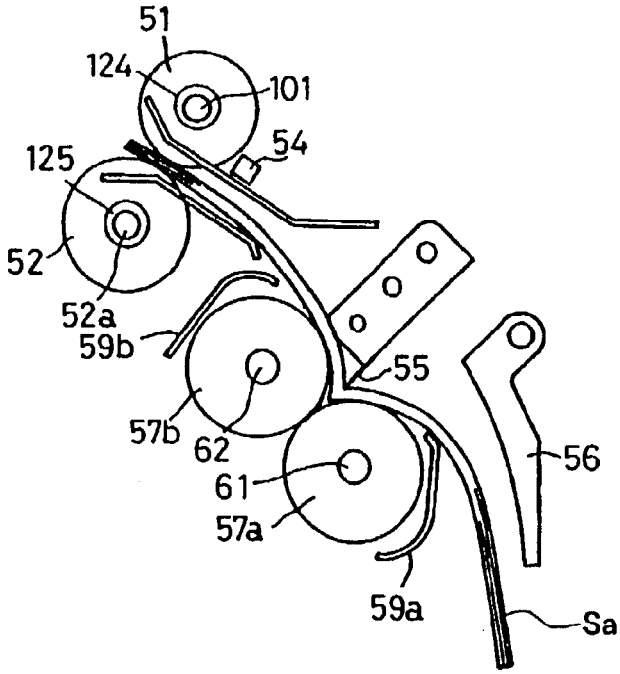

The stapling/folding motor 170 rotates in a direction opposite to that for the stitching operation. As shown in FIG. 10(B) and FIG. 24(B), the folding rollers 57*a* and 57*b* rotate in a direction to nip the sheet stack Sa while the pushing plate 55 is lowered. In synchronization with the lowering operation of the pushing plate 55, the backup guides 59*a* and 59*b* move to expose the circumferences of the folding rollers 57*a* and 57*b* facing the sheet stack Sa. When the pushing plate 55 is lowered, the sheet stack Sa is nipped and wound between the folding rollers 57*a* and 57*b*. The pushing plate 55 then moves away from the sheet stack Sa, and the sheet stack Sa is further folded between the folding rollers 57*a* and 57*b* (i.e., conveyed in the nipped state).

The sheet stack Sa conveyed in the nipped state is then discharged into and stocked on the folded sheet stack discharge stacker 80. With the folded sheet pressure member 81 pressing the sheet stack Sa, the folded sheet stack (a booklet) does not interfere with the next booklet.

After the folding operation starts, when the pushing plate HP sensor 169 detects that the pushing plate 55 moves reciprocally by the length of the sheet stack Sa in the sheet conveyance direction by a predetermined number of times, the controller 149 stops the stapling/folding motor 170. After the time elapse from the start of the folding operation until the sheet stack Sa is nipped between the folding rollers 57*a* and 57*b*, the stack conveyance upper roller 51 is raised and spaced apart from the stack conveyance lower roller 52 to be ready for an entry of the next sheet stack.

After pushing the sheet stack Sa between the folding rollers 57*a* and 57*b*, the pushing plate 55 moves to the pushing position again for folding the sheet stack Sa. The timing of sheet folding between the folding rollers 57*a* and 57*b* and the timing of movement of the pushing plate 55 are set so that the pushing plate 55 does not contact both edges of the folded sheet stack Sa when the pushing plate 55 moves again to the pushing position. With this arrangement, even when the common driver, i.e. the stapling/folding motor 170, drives the pushing plate 55 and the folding rollers 57*a* and 57*b*, the sheet stack Sa is not damaged. Furthermore, the sheet post-processing device 2 can be made small.

The advantages of the digital copying apparatus 1A of the embodiment of the present invention will be explained. The digital copying apparatus 1A of the present invention includes the digital copying apparatus main unit 1 and the sheet post-processing device 2 detachably mounted on the digital copying apparatus main unit 1, and the sheet post-processing device 2 includes the conveyance unit 100, offset unit 20, stapler unit 30, folding unit 50, etc. Therefore, it is possible to process the sheets discharged from the digital copying apparatus main unit 1 in a variety of modes.

In particular, as shown in FIGS. 14(B) and 14(C), the sheets not to be stitched are shifted from the stitched sheets in the side stapling mode and side stapling offset insert mode. The reader can pull the unstitched sheets from the sheet stack to compare the unstitched sheets with the stitched sheets of the sheet stack. In the side stapling offset mode, the edges of the unstitched sheets are shifted, so that a particular unstitched sheet is easy to pull out. Even after all the unstitched sheets are pulled out, any particular one from among them is easy to pull out. For this reason, the sheet stack (booklet) produced by the digital copying apparatus 1A allows the reader to easily and quickly understand the relationship of the contents of the booklet.

Further, since the unstitched sheets and stitched sheets are handled as a bundle, it is easy to distribute the booklet as a document. In view of providing such a document to the reader and eliminating the distribution of the unstitched sheets, an image forming apparatus such as the digital copying apparatus having this function is useful in industrial applications.

In the digital copying apparatus 1A according to the present invention, as shown in FIG. 17(B), all the sheets are held on the process tray 8 (and first stack guide 27) with the stopper 21 at the restraining position when the paddle 17 urges the next sheets to the stopper 21. The shifted posture of all the sheets will be destroyed on the process tray 8 and first stack guide 27 if the conveyance upper roller 19 remains at the spaced position to allow the paddle 17 to urge the sheets toward the stopper 21 and all the sheets remain in a non-held state on the process tray 8 and first stack guide 27. In the present invention, since the sheet pressing levers 300 and 310 hold all the sheets on the process tray 8, the posture of the shifted sheets is maintained, thereby obtaining the sheet stack and booklet free from shifted posture destruction.

Figure 21:
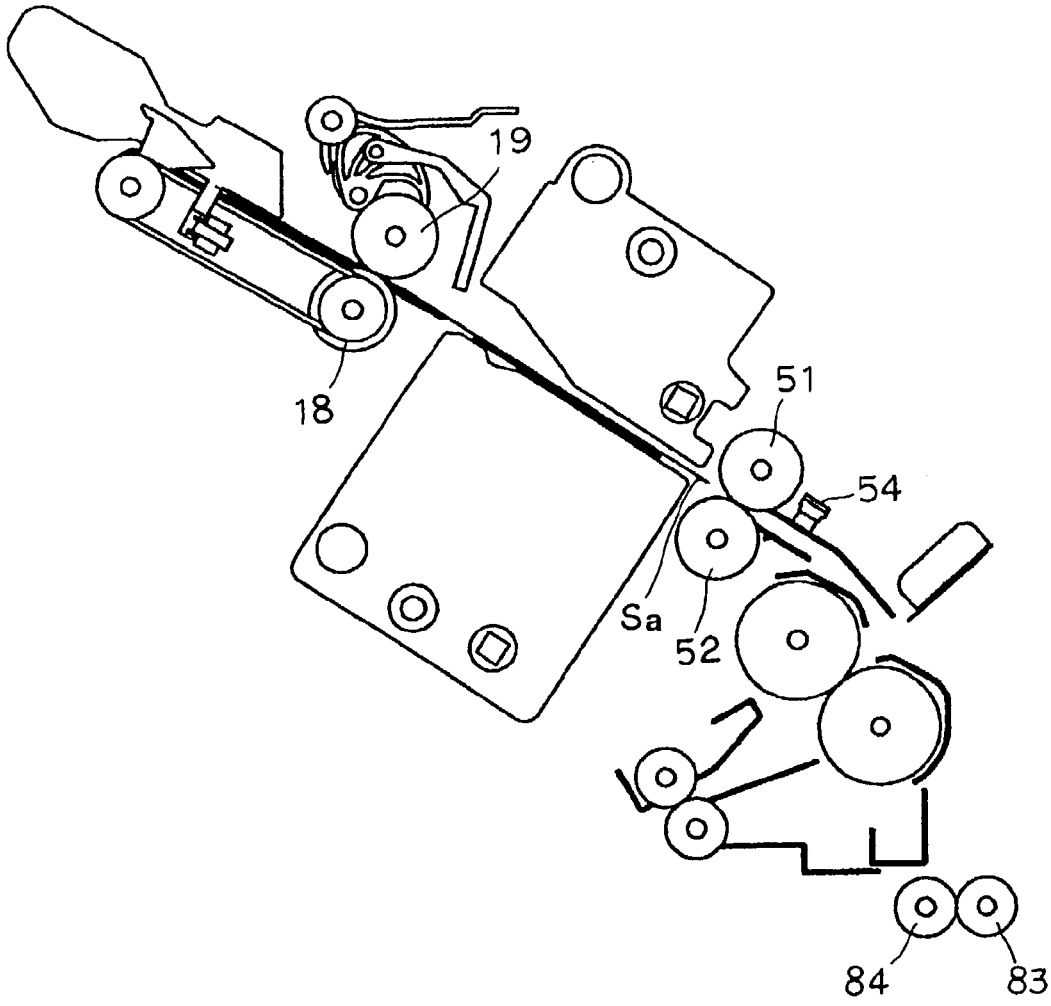
FIG. 21 is the first diagram explaining a conveyance operation of a sheet stack around the offset unit, stapler unit, and folding unit in the insert mode and offset insert mode.

Further, in the digital copying apparatus 1A according to the present invention, when the sheet stack Sa is conveyed to the box-like stack container 88, the conveyance upper roller 19, stack conveyance upper roller 51, and driving roller 84 successively move away from the conveyance lower roller 18, stack conveyance lower roller 52, and driven roller 83, respectively. Therefore, the rear edges of the sheets not to be stitched and inserted into the sheet stack Sa do not contact these rollers as shown in FIGS. 21–23. With this arrangement, it is possible to prevent the unstitched sheets from being accidentally pulled out of (coming off) the sheet stack Sa in the conveyance process and the shifted posture from being destroyed.

Further, in the digital copying apparatus 1A according to the present invention, the stapler unit 30 performs the side stitching operation so that the forward edge of the sheet not be stitched is shifted from the forward edge of the sheet to be stitched by the offset a larger the distance b between the forward edge of the sheet to be stitched and the stitching position of the staple as shown in FIGS. 14(B) and 14(C). With this arrangement, it is possible to prevent the sheets not to be stitched from being accidentally stitched even if the components forming the sheet post-processing device 2 are aged.

Further, in the digital copying apparatus 1A according to the present invention, as shown in FIG. 3, it is possible to stack the sheet stack on either the lower-side lifting tray 90 or the upper-side box-like stack container 88 depending on the user's selection. When a different mode is carried out, the sheet stack is discharged to a different destination requested by the operator. For example, the sheet stack formed in the side stapling insert mode may be discharged into the one, and the sheet stack formed in the side stapling offset insert mode may be discharged into the other destination.

Further, in the digital copying apparatus 1A according to the present invention, the conveyance lower roller 18 and conveyance upper roller 19 convey the sheet stack to the stapler unit 30, and also shift the sheet stack by the offset a in the shifting process. The stopper 21 presses the sheet stack from above at the bottom face thereof, and, in addition, restrains the sheets with the sidewall of the stopper 21. With this arrangement, the number of the components of the offset unit 20 is reduced. This arrangement implements a compact design not only in the offset unit 20 but also in the sheet post-processing device 2.

In the embodiments, the buttons on the touch panel 248 are pressed to set the operational modes. As described above, it is possible to input through an external apparatus such as the personal computer 210 or a manual button. The image data is stored in the hard disk 961. Alternatively, the image data may be stored in a volatile memory such as a RAM in the controller 950, or a non-volatile memory such as an EEPROM other than the hard disk.

Further, in the digital copying apparatus 1A according to the present invention, the sheet post-processing device 2 is mounted on the digital copying apparatus main unit 1. In the case of the sheet post-processing device commercially available as an independent item, it is possible to obtain the same advantages as the sheet post-processing device 2 of the present invention when an interface is provided for transferring a control signal from the controller in the digital copying apparatus main unit 1 to the controller in the sheet post-processing device.

In the embodiments, the operator inputs the offset and the like through the touch panel 248 in the digital copying apparatus main unit 1. Alternatively, the operator may input through the sheet post-processing device 2. In this case, the ROM of the controller 149 in the sheet post-processing device 2 may store a program and program data identical to those in the controller 950 in the digital copying apparatus main unit 1. Alternatively, the controller 950 may transfer a part of the program and program data through the interface when the controller 149 is powered on.

Further, in the embodiments, no particular order of sequence is defined for the inputting through the touch panel 248 and the image reading by the image input unit 200 (and storage of the image data onto the hard disk 961). The image data is stored in the hard disk 961 and then the folder name is prompted subsequent to the setting of the mode selection information. Alternatively, the setting of the mode selection information may be performed before the image reading.

Further, in the embodiments, the sheet post-processing device 2 includes the folding unit 50. Alternatively, without the folding unit 50, the sheet post-processing device 2 can be made compact at a lower cost. The first stack guide 27 and process tray 8 are two separate units in the embodiments. Alternatively, the process tray 8 may extend to one side (the side of the stapler unit 30) by a length corresponding to the first stack guide 27.

In the embodiments, the sheets not to be stitched are shifted in the sheet conveyance direction on the process tray 8 and first stack guide 27. Alternatively, the sheets may be shifted in a direction perpendicular to the sheet conveyance direction. It is also perfectly acceptable that the sheets are shifted in both the sheet conveyance direction and the direction perpendicular to the sheet conveyance direction. With this arrangement, the unstitched sheets are more easily pulled out of the sheet stack.

As described above, according the present invention, the offset unit shifts the sheet to be stitched from the sheet not to be stitched, and the stitching unit stitches only the sides of the sheets to be stitched. Therefore, the unstitched sheets are easily pulled out of the stack sheet. The user easily compares the pulled sheets with the stitched sheets.

While the invention has been described with reference to the specific embodiments of the invention, the explanation is illustrative and the invention is limited only by the appended claims.

What is claimed is:

1. A sheet post-processing device for post-processing a sheet, comprising:

placement means for placing sheets discharged from an image forming apparatus;

discharging means for successively discharging the sheets on the placement means;

offset means for shifting an edge of a non-stitching sheet from an edge of a stitching sheet on the placement means by a predetermined distance according to whether the sheet discharged on the placement means is subjected to a stitching process; and stitching means for stitching edge portions of the stitching sheets in a stack in a state that the edge of the non-stitching sheet is shifted from the edges of the stitching sheets by the offset means, wherein in stitching the sheets, a first sheet and a last sheet in the sheets are not shifted by the offset means and stitched together to hold all sheets between the first and last sheets.

2. A sheet post-processing device according to claim 1, further comprising conveyor means for conveying the stack of the sheets stitched by the stitching means; and storing means for storing the stack of the sheets conveyed by the conveyor means.

3. A sheet post-processing device according to claim 2, wherein said conveyor means conveys the stack of the sheets to the storing means such that the edges of the sheets stitched by the stitching means are oriented toward upstream in a direction that the conveyor means conveys the stack of the sheets.

4. A sheet post-processing device according to claim 3, wherein said conveyor means conveys the stack of the sheets to the storing means such that the edges of the sheets stitched by the stitching means contact the conveyor means.

5. A sheet post-processing device according to claim 2, wherein said conveyor means conveys the stack of the sheets to the storing means such that the edges of the sheets stitched by the stitching means are oriented toward downstream in a direction that the conveyor means conveys the stack of the sheets.

6. A sheet post-processing device according to claim 5, wherein said conveyor means contacts only the sheets stitched by the stitching means.

7. A sheet post-processing device according to claim 1, wherein said stitching means stitches the stitching sheets at a position within a predetermined distance from the edges of the stitching-sheets.

8. A sheet post-processing device according to claim 1, wherein said offset means shifts at least one sheet between the first and last sheets not to be stitched together.

9. A sheet post-processing device according to claim 1, wherein said offset means includes a stopper which can be placed on a sheet on the placement means for holding the sheet, and can align the sheet discharged onto the placement means.

10. A sheet post-processing device for post-processing a sheet, comprising:

placement means for placing sheets discharged from an image forming apparatus;

discharging means for successively discharging the sheets on the placement means;

offset means for shifting an edge of a non-stitching sheet from an edge of a stitching sheet on the placement means by a predetermined distance according to whether the sheet discharged on the placement means is subjected to a stitching process; and stitching means for stitching edge portions of the stitching sheets in a stack in a state that the edge of the non-stitching sheet is shifted from the edges of the stitching sheets by the offset means, wherein said offset means shifts the edge of the non-stitching sheet from an edge of a next non-stitching sheet.

11. A sheet post-processing device for post-processing a sheet, comprising:

placement means for placing sheets discharged from an image forming apparatus;

discharging means for successively discharging the sheets on the placement means;

offset means for shifting an edge of a non-stitching sheet from an edge of a stitching sheet on the placement means by a predetermined distance according to whether the sheet discharged on the placement means is subjected to a stitching process; and stitching means for stitching edge portions of the stitching sheets in a stack in a state that the edge of the non-stitching sheet is shifted from the edges of the stitching sheets by the offset means, wherein said offset means comprises a restraining member movable between a restraining position where the restraining member restrains and aligns the edge of the sheet discharged on the placement means and a retracting position where the restraining member is retracted from the restraining position, an urging member for urging the sheet discharged on the placement means by the discharging means toward the restraining member, and a sheet moving member movable between a first position where the sheet moving member moves the sheet on the placement means and a second position where the sheet moving member is located away from the sheet on the placement means to allow the urging member to urge the sheet.

12. A sheet post-processing device according to claim 11, wherein said urging member urges the sheet toward the restraining member so that the stitching sheet is placed on the placement means at a position different from that of the non-stitching sheet in a state that the restraining member is situated at the restraining position and the sheet moving member is situated at the second position.

13. A sheet post-processing device according to claim 12, wherein said urging member urges the sheet so that a forward edge of the stitching sheet is shifted from a forward edge of the non-stitching sheet by a predetermined distance.

14. A sheet post-processing device according to claim 13, wherein said urging member urges the sheets so that a forward edge of the non-stitching sheet is shifted from a forward edge of a next not-stitching sheet by a predetermined distance.

15. A sheet post-processing device according to claim 11, wherein said sheet moving member at the first position nips and moves the sheets on the placement means in a state that the stitching sheet is placed at a position different from that of the non-stitching sheet while the restraining member is situated at the retraction position.

16. A sheet post-processing device according to claim 11, wherein said sheet moving member moves the non-stitching sheets on the placement means at different positions.

17. A sheet post-processing device according to claim 11, further comprising a pressing member for pressing the sheets on the placement means after the non-stitching sheet is stacked on the stitching sheet and when the urging member urges a next stitching sheet while the restraining member is situated at the restraining position and the sheet moving member is situated at the second position.

18. An image forming apparatus comprising:

the sheet post-processing device according to claim 11;

designating means for designating the sheets as to whether the sheets are to be stitched or not; and notifying means of sending, to the sheet post processing device, a signal of information of the sheets designated by the designating means as to whether the sheets are to be stitched or not.

* * * * *